US005684668A

United States Patent [19]

Muramatsu et al.

[11] Patent Number: 5,684,668

[45] Date of Patent: Nov. 4, 1997

[54] MAGNETIC CONTACTOR HAVING PHASE ANGLE ADJUSTER

[75] Inventors: Naoki Muramatsu; Yoshihide Kinbara, both of Aichi, Japan

[73] Assignee: Mitsubishi Denki Kabushiki Kaisha, Tokyo, Japan

[21] Appl. No.: 444,028

[22] Filed: May 18, 1995

[30] Foreign Application Priority Data

Dec. 27, 1994 [JP] Japan ..... 6-324974

[51] Int. Cl.[6] ..... H01H 9/56; H01H 47/22

[52] U.S. Cl. ..... 361/185; 307/131

[58] Field of Search ..... 361/153, 154, 361/185, 195, 196, 2–4; 307/125, 130, 131, 139–141.4

[56] References Cited

U.S. PATENT DOCUMENTS 4,864,157 9/1989 Dickey ..... 361/3
4,922,363 5/1990 Long et al. ..... 361/3
5,440,180 8/1995 DeVault et al. ..... 307/138

FOREIGN PATENT DOCUMENTS 28 16 558 10/1979 Germany .
31 10 314 4/1982 Germany .
32 32 864 8/1986 Germany .
44 09 010 9/1994 Germany .
51-32297 9/1976 Japan ..... H01H 9/56

*Primary Examiner*—Fritz Fleming
*Attorney, Agent, or Firm*—Sughrue, Mion, Zinn, Macpeak & Seas, PLLC

[57] ABSTRACT

A magnetic contactor including a phase switch and a phase angle adjusting device for adjusting the phase angle at which the phase switch provides for the supply of voltage to an electromagnet to energize the electromagnet. The phase angle is adjusted, via the phase angle adjusting device, to a position at which a collision velocity of a movable iron core against a fixed iron core of the magnetic contactor is lowered, and where the impact of the movable iron core is reduced to increase the life of the magnetic contactor.

14 Claims, 22 Drawing Sheets

ELECTROMAGNET VOLTAGE
150
α=35°

SIGNAL GENERATOR
151
155

ELECTROMAGNET CURRENT
MOTION OF MOVABLE IRON CORE
152
153
154

CONTACT

T0
T1
T2
T11
T4
T5
T12

ELECTROMAGNET VOLTAGE
150
α=73°

SIGNAL GENERATOR
151
165

ELECTROMAGNET CURRENT
MOTION OF MOVABLE IRON CORE
163
162

T0
T1
T2
T11
T4
T5

MAGNETIC CONTACTOR HAVING PHASE ANGLE ADJUSTER

BACKGROUND OF THE INVENTION

1. Field of the Invention

The present invention relates to a magnetic contactor which energizes or de-energizes the coils of an electromagnet to attract or repel a movable iron core to or from a fixed iron core, thereby opening or closing a contact.

2. Description of Prior Art

A conventional magnetic contactor will be described in accordance with FIG. 26, which is a sectional view of the electromagnet of the magnetic contactor. The structure of the magnetic contactor is largely divided into a movable section consisting of a movable iron core 1, and a movable contactor (not shown) coupled with the movable iron core 1, and a fixed section made up of a fixed iron core 20, coils 21, etc. The fixed iron core 20 is contained in a mount (not shown) via a rubber plate 22 or an impact cushioning member. The coils 21 are wound around bobbins 24 and fitted to the center pole of the fixed iron core 20. A conical tripping spring 31 is disposed between the center pole of the movable iron core 1 and the bobbins 24.

The operation of the magnetic contactor will now be described with reference to FIG. 26. When current flows in the coils 21, the fixed iron core 20 is magnetized to generate magnetic attraction between itself and the movable iron core 1, causing the movable iron core 1 to be attracted to the fixed iron core 20 against the tripping spring 31. In the process of this joint operation, the contact of the movable contactor (not shown) is pressed against the contact of a fixed contactor and is closed. When the current to the coils 21 is shut off, the magnetic attraction between the fixed iron core 20 and the movable iron core 1 terminates and the tripping spring 31 causes the movable iron core 1 to move to the original position, opening the contacts. The power of the electromagnet is thus switched on-off directly.

Another conventional magnetic contactor will be described in accordance with FIGS. 27(*a*) and 27(*b*), showing a "contact actuation circuit" disclosed in Japanese Laid-Open Patent Publication No. SHO51-32297, and related graph. This contact actuation circuit is designed to set the actuation phase angle of a coil to a phase angle where chattering rarely occurs. In FIG. 27(*a*), the coil 21, an alternating-current power supply 100 and a control rectification device 41 are connected in series with each other via an actuation switch 11. Also, the power supply 100 and a phase signal generation circuit 40 are connected in series with each other via the actuation switch 11. The phase signal generation circuit 40 is designed to generate a trigger signal which is supplied to the control rectification device 41 when the voltage of the alternating-current power supply 100 reaches a value $V_{BO}$.

FIG. 27(*b*) shows a relationship between the voltage $V_{BO}$ of the phase signal generation circuit 41 and the voltage waveform of the power supply 100. As shown in this drawing, the phase angle corresponding to the voltage $V_{BO}$ is 25° . Therefore, when the actuation switch 11 is closed between 0° and 25° , the coil 21 is energized. On the other hand, when the switch 11 is turned on at the phase angle of 25° or more, there is a delay until the next cycle of 0° to 25° is reached, and the control rectification device 41 is then caused to conduct to energize the coil 21, thereby reducing the occurrence of contact chattering.

In the first conventional magnetic contactor, as described above, the actuation phase angle of the power supply is optional, whereby the collision velocity of the movable iron core 1 against the fixed iron core 20 varies greatly.

In the second conventional device, the phase angle is set to a phase at which contact chattering is reduced. However, the velocity at which the movable iron core 1 collides against the fixed iron core 20 cannot be sufficiently suppressed for the following reason. Namely, in order to reduce contact chattering, the collision velocity of the movable and fixed contacts is set to a low value halfway through a stroke in which the movable iron core 1 is attracted to the fixed iron core 20. On the other hand, in order to decrease the impact generated when the movable iron core 1 collides with the fixed iron core 20, the velocity at almost the last point in the stroke of the movable iron core 1 is reduced, which is different from the reduction of the velocity at a specific passage point in the stroke of the movable iron core 1.

In order to review the above points, an example is shown in FIG. 28, wherein a vertical axis V, representing an attraction velocity of a movable iron core 1, relates to a horizontal axis X, representing the movement of a movable iron core 1 of the electromagnetic contactor. In FIG. 28, an actuation phase angle α of the power supply is 35° and 90° , and the iron core collides with a fixed contact (contactor) when the iron core 1 is about 4 mm in stroke.

As shown in FIG. 28, both in the case of an actuation phase angle of 35° , and in the case of an actuation phase angle of 90° , the velocity V upon actuation of a contactor is about 0.6 m/s when the iron core is about 2.5 mm in stroke. However, the velocity V when the iron core collides with the fixed iron core 20 varies according to an actuation phase angle of a power source. Namely, the velocity V is about 1.6 m/s in case of α of 90° , and is four times as large as the velocity V about 0.4 m/s in case of α of 35° . The chattering time of the contactor depends on the actuation velocity, and the larger the actuation velocity is, the longer the chattering time is. Therefore, in the example illustrated in FIG. 28, the chattering times are substantially the same, but the collision force in the case of 90° is 4 times that of the collision force in the case of 35° . Hence, although the velocity at which the movable iron core 1 in the process of movement makes contact was decreased to reduce chattering, the velocity at which the movable iron core 1 collides with the fixed iron core 20 increased, decreasing the life of the magnetic contactor.

Further, although the impact of the movable iron core 1 was small, contact chattering was likely to occur, whereby arc discharges were generated at the contact, reducing the life of the contact.

SUMMARY OF THE INVENTION

It is accordingly a first object of the present invention to overcome the above-mentioned problems by providing a long-life magnetic contactor which can reduce impact of a movable iron core by controlling the phase angle at which the coils of the magnetic contactor are energized.

It is a second object of the present invention to provide a long-life magnetic contactor which can reduce impact of a movable iron core, and to provide a contact which can prevent arc discharges.

DESCRIPTION OF THE PREFERRED EMBODIMENTS

Embodiment 1

Figure 1:
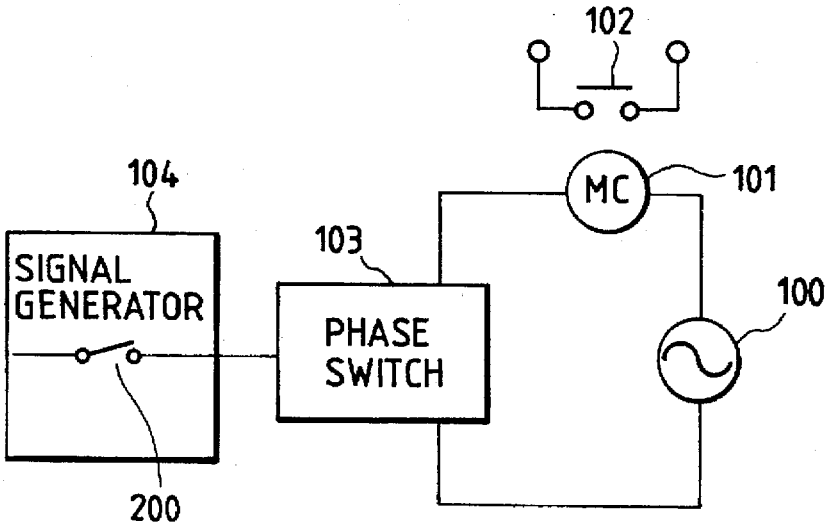
FIG. 1 is a circuit diagram showing an embodiment of the present invention.

An embodiment of a magnetic contactor according to the present invention will be described with reference to FIG. 1, wherein an alternating-current power supply 100, an electromagnet 101 with contract 102 and a phase switch 103 incorporating a switch device are connected in series with each other, and a signal generator 104, designed to generate an operation signal to actuate the switch, is connected with the phase switch 103. The phase switch 103 controls the supply of voltage from the alternating-current power supply 100 to the coils 101 so that the voltage is switched on with a delay of a given phase angle α after zero (hereinafter referred to as the "actuation phase angle"). The signal generator 104 contains a normally open contact 200, and outputs an on-off command to the phase switch 103 depending on whether the normally open contact 200 is open or closed.

Figure 2:
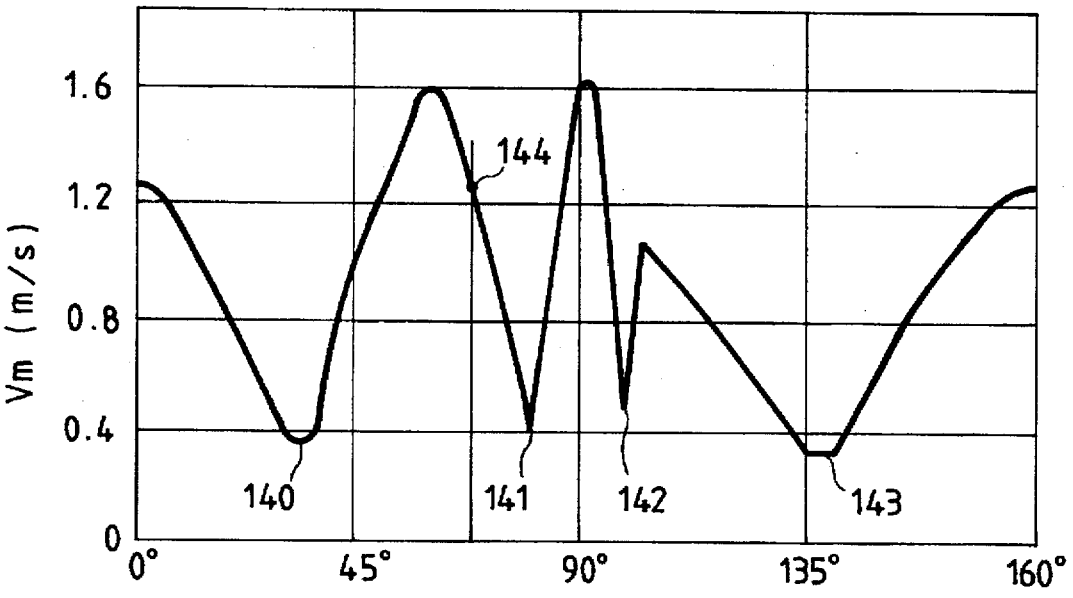
FIG. 2 is a curve showing the operation of a magnetic contactor according to the present invention.

A relationship between the actuation phase angle α and a collision velocity Vm, at which the movable iron core 1 collides against the fixed iron core 20 is shown in FIG. 2. The vertical axis represents the collision velocity Vm, while the horizontal axis represents the actuation phase angle α. The collision velocity Vm varies greatly between approximately 0.4 and 1.6 m/s according to variation in the actuation phase angle α. The actuation phase angle α is set to any of points 140, 141, 142 and 143 where the collision velocity Vm decreases. Around the points, the values of "Vm" is small, and the differential value dVm/Dα thereof is close to zero. In general, the collision force by the iron core is proportional to the collision velocity. Therefore, the smaller the collision velocity, the smaller the collision force, and the longer the life time of the iron core. However, taking an error of actuation into consideration, the actuation phase α is set to be in a range of about ±5%. It is to be understood that if the permissible range of the collision velocity is varied, other phase angles may be used.

Figure 3:
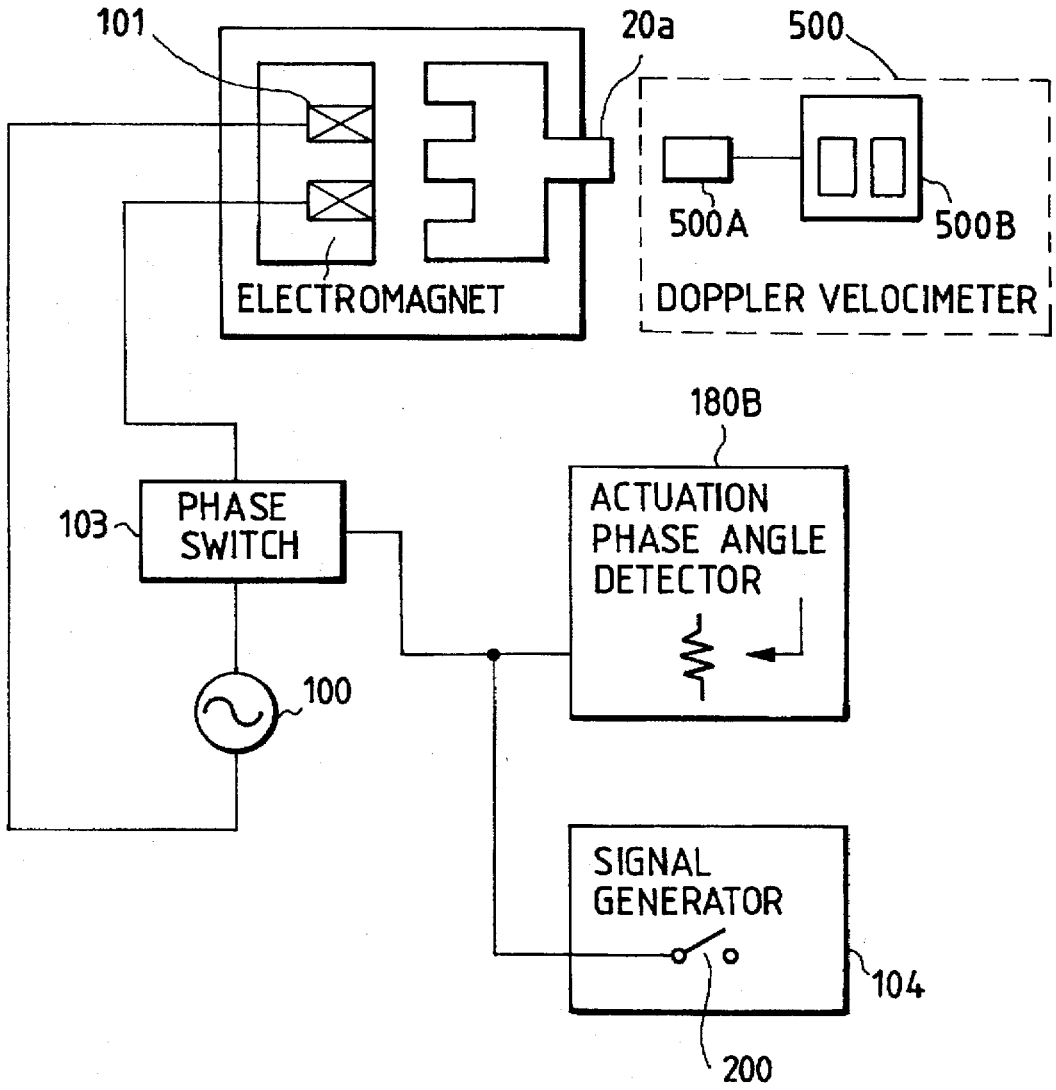
FIG. 3 is an actuation phase angle setting circuit according to the present invention.

Specific setting means for the actuation phase angle α of the phase switch 103 will now be described in accordance with FIG. 3, wherein the alternating-current power supply 100, the electromagnet 101 and the phase switch 103 are connected in series with each other, and the signal generator 104 is connected to the phase switch 103. An actuation phase angle detector 180B, provided as a phase angle adjustment device, is connected to the phase switch 103. The actuation phase angle α can be optionally set by the actuation phase angle detector 180B by means of a variable resistor. The detailed structure of the actuation phase angle detector 180B is given in an embodiment described later. A probe 500A of a non-contact laser Doppler velocimeter 500 is disposed in parallel to a top projection 20*a* of the movable iron core 1.

In the above configuration, the normally open contact 200 is closed to place the phase switch 103 in an on-ready state, and the actuation phase angle α of the switch 103 is set by the variable resistor in the actuation phase angle detector 180B. In such a setting, the phase switch 103 is turned on to energize the coils 101, whereby the movable iron core 1 is operated and the velocity displayed on an indicator 500B is visually checked by a measurer. The series of operations are repeated for each setting of the actuation phase angle α with the variable resistor, and the actuation phase angle α at which the velocity of the movable iron core 1 decreases is set with the variable resistor.

It is to be understood that while the velocity of the movable iron core 1 was directly detected as described above, the variation L of the movable iron core 1 may be measured by means of a differential transformer using movement time t measured simultaneously, where L/t is computed to detect the velocity of the movable iron core 1 indirectly.

Figures 4A, 4B, 4C, 4D, 4E, 4F:
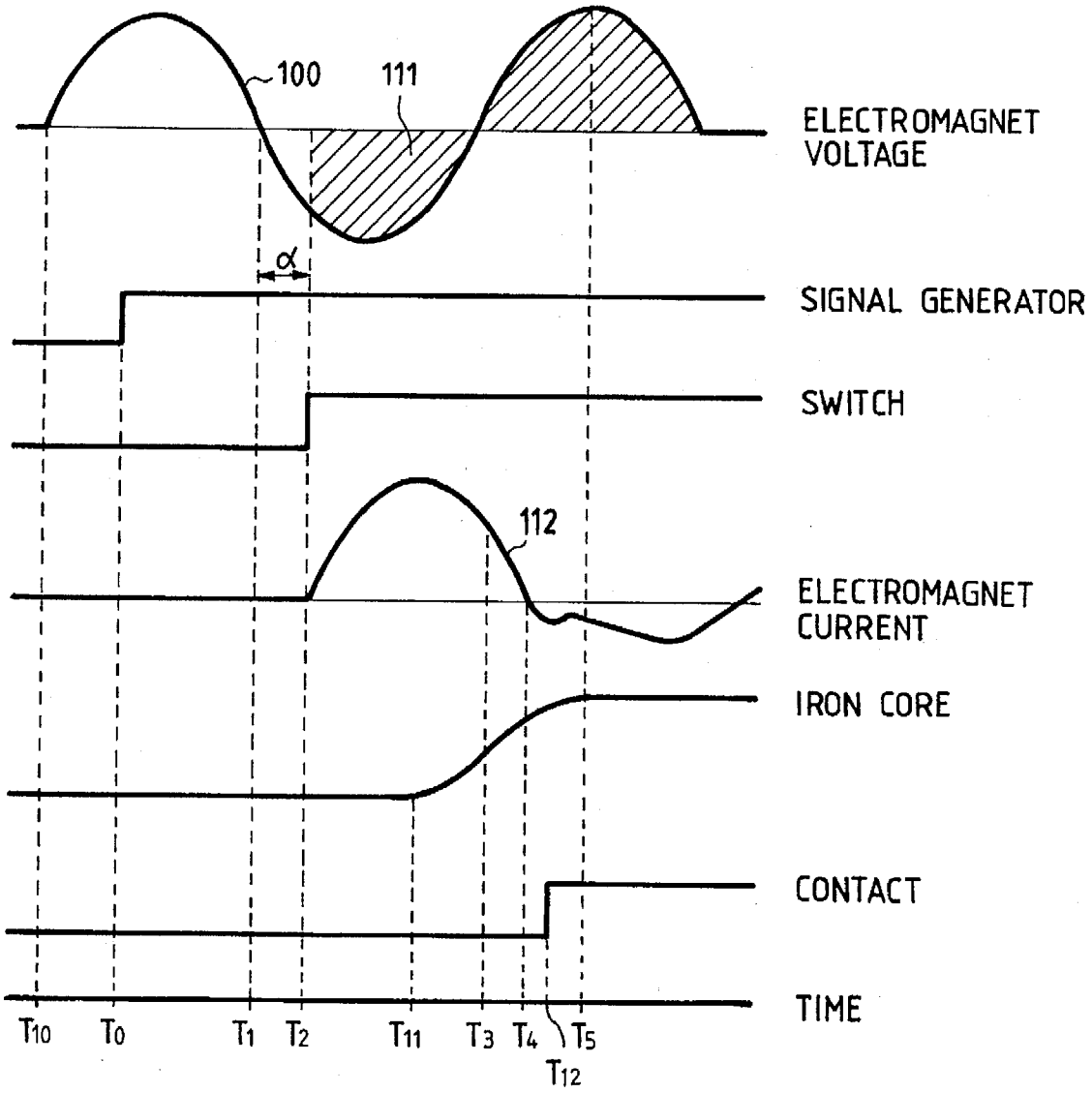
FIGS. 4(*a*)–4(*f*) show waveform diagrams and timing charts for illustrating the operation of the circuit shown in FIG. 1.

The operation of the present embodiment will be described with reference to waveform diagrams illustrated in FIGS. 4(*a*)–4(*g*). First, the actuation phase angle α is set to a phase angle equivalent to point 140 in FIG. 2. Then, the normally open contact 200 in the signal generator 104 is closed at time T0, as shown in FIG. 4(*b*). The closure of the contact causes the phase switch 103 to turn on at time T2 with a delay of the given phase angle α after time T1, as shown in FIG. 4(*c*). Therefore, a hatched voltage 111 is applied to the electromagnet 101 as shown in FIG. 4(*a*), and a current 112 flows in the electromagnet 101 as shown in FIG. 4(*d*), causing magnetic force to attract the movable iron core 1 to the fixed iron core 20. As shown in FIG. 4(*e*), because of inertia, the movable iron core 1 begins to move at time T11 soon after the current 112 has started to flow. The iron core 1 gradually gathers velocity, and collides with the fixed iron core 20 at time T5. Also, there are changes in the current 112, as shown in FIG. 4(*d*), between acceleration at time T11 and the collision at time T5. The attraction for the movable iron core 1, which is proportional to the square of the current, is zero at point T4 when the current 112 is zero (hereinafter referred to as the "zero cross point"). Hence, the movable iron core 1 loses velocity, pushed by the counterforce of the tripping spring 31, etc., and the collision velocity is minimized at time T5 just when the movable iron core 1 collides against the fixed iron core 20. Also, as shown in FIG. 4(*f*), the contact 102 is closed at time T12 when the movable iron core 1 is in the process of being attracted.

The contact 102 is closed near the current zero cross point T4 when the electromagnet 101 is energized at a phase angle at which the collision velocity is reduced as indicated by time T12 in FIG. 4(*f*). Accordingly, an effect identical to that of this embodiment is produced by turning the phase switch 103 on near the point when the contact 102 closes after the electromagnet 101 has been energized and at the actuation phase angle α at which the current flowing in the electromagnet 101 is zero.

Embodiment 2

Figure 5:
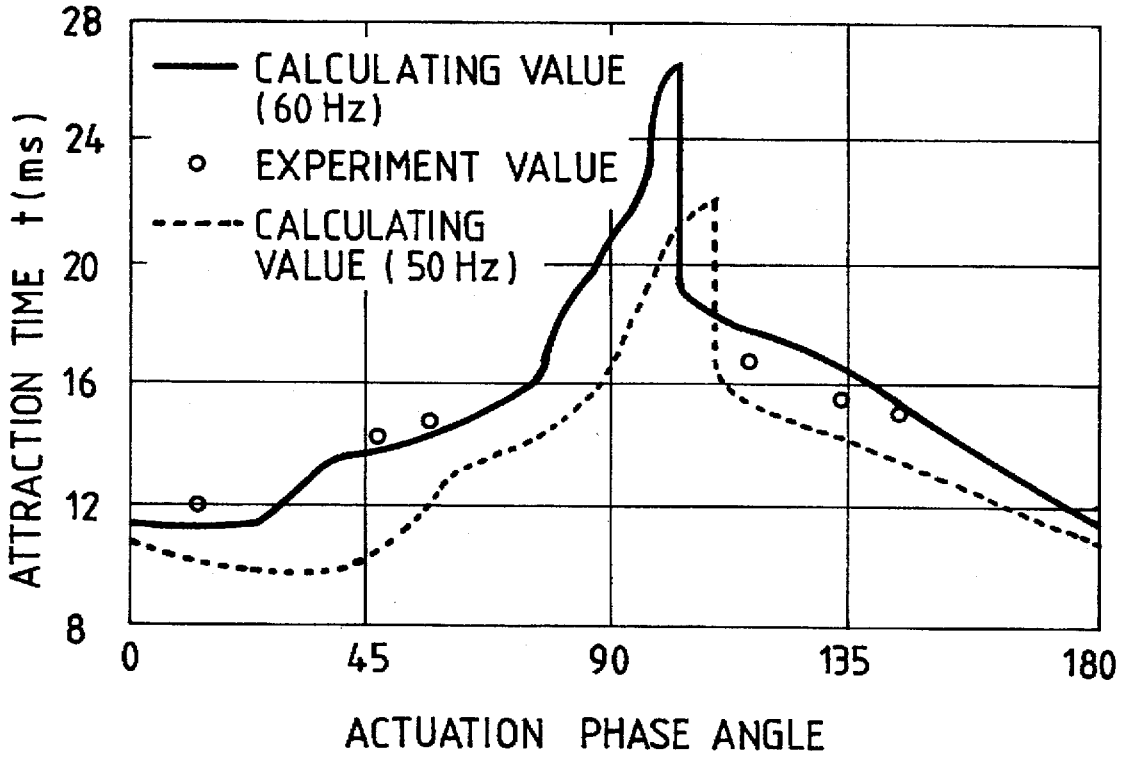
FIG. 5 is a graph showing the operation of the magnetic contactor according to the present invention.

Another embodiment of the present invention will be described in accordance with FIG. 5, wherein the vertical axis represents a period of time when the movable iron core 1 has energized the electromagnet 101 until it collides with the fixed iron core 20 (hereinafter referred to as the "attraction time"); namely, the time from T2 when a phase switch 103 is turned on, to time T5 when the movable iron core 1 collides with the fixed iron core 20 in FIGS. 4(*a*)–4(*f*). The abscissa designates calculation and experimental data showing the actuation phase angle α. As shown in FIG. 5, the attraction time t more than doubles from 11 to 26 ms at the power supply frequency of 60 Hz.

As described previously, the actuation phase angle α at a low collision velocity Vm is at points 140, 141, 142 and 143 in FIG. 2. However, the attraction time at points 141 and 142 in FIG. 2 is longer than that illustrated in FIG. 5. Since the phase angle at a low collision velocity is also smaller in width at points 141, 142, the phase angle at these points is not preferable. The operating width of the phase angle is large at point 143, but the phase angle equivalent to point 143 is 135° , which is converted into a time of 6.25 ms on the assumption that the frequency of the alternating-current power supply 100 is 60 Hz. Since the actuation phase angle α must also be considered for the ordinary operation time of the magnetic contactor, the length of time of 6.25 ms from when the operation signal is generated to turn on the switch until the actuation of the magnetic contactor is complete (hereinafter referred to as the "full operation time") is not preferable to maintain the performance level of the magnetic contactor. Hence, the actuation phase angle of approximately 35° , equivalent to point 140, is the most preferable phase angle when the full operation time and the like are taken into consideration.

It is to be noted that there are many magnetic contactor types which are classified by electromagnet operation forms (such as plunger and flat plate types), contact capacitances, etc., which are characterized by different attraction times and collision velocities. Also, the attraction time and the like differ depending on the mounting direction of the magnetic contactor. However, actuation impact can be reduced by selecting the actuation phase angle at which the collision velocity for each magnetic contactor decreases and the attraction time is short, and by energizing the electromagnet 101 at the selected actuation phase angle.

Figures 6A, 6B, 6C, 6D, 6E:
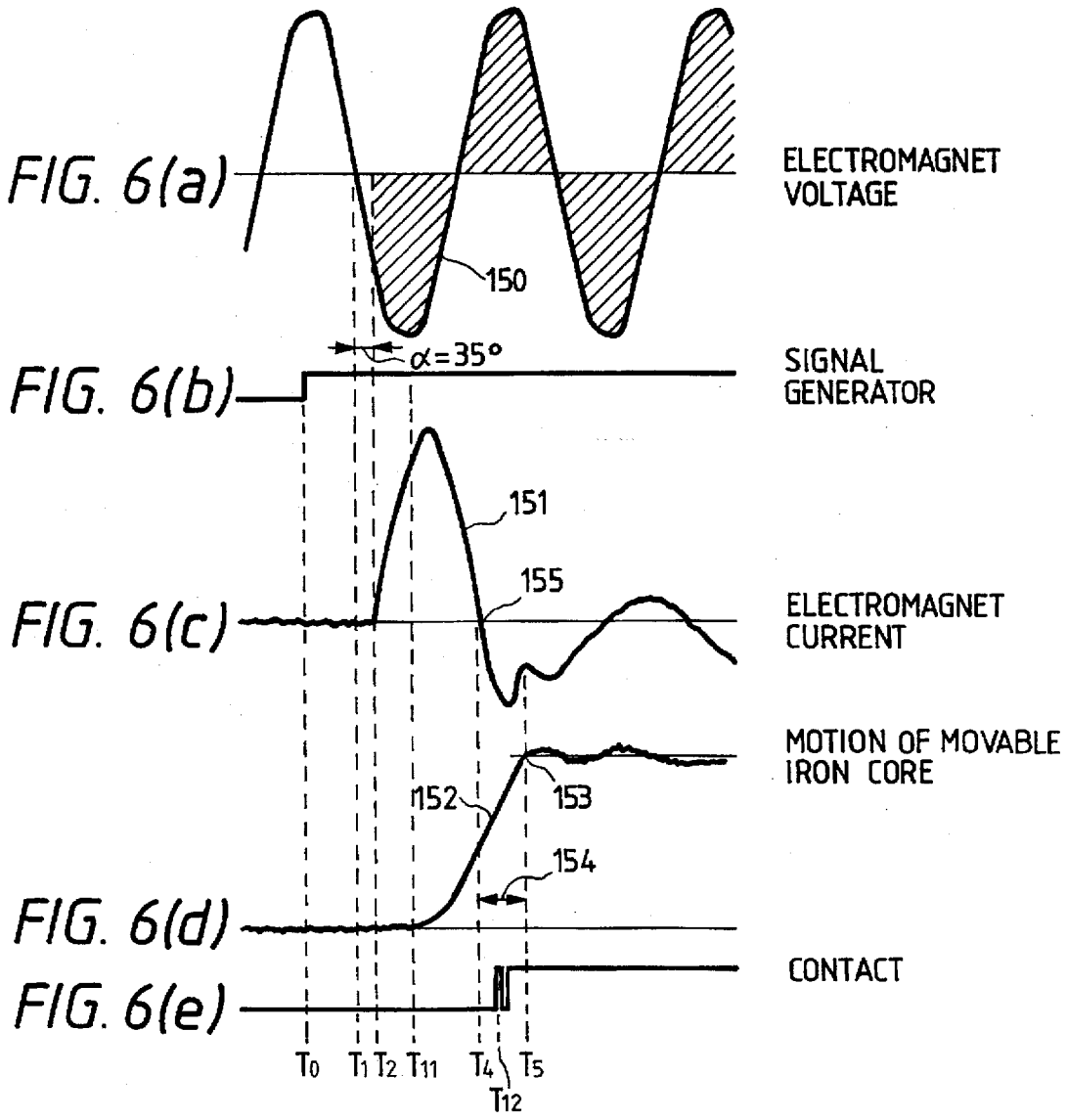
FIGS. 6(*a*)–6(*e*) illustrate actual waveform diagrams according to the present invention.

The actual operation waveform of the magnetic contactor will now be described in accordance with FIGS. 6(*a*)–6(*c*), wherein the normally open contact 200 in the signal generator 104 is closed at time T0 as shown in FIG. 6(*b*), and the phase switch 103 is turned on at the actuation phase angle α of approximately 35° to apply a hatched voltage 150 to the electromagnet 101, as shown in FIG. 6(*a*). When the voltage is applied, a current 151 flows in the electromagnet 101, as shown in FIG. 6(*c*), to cause magnetic attraction, and the movable iron core 1 begins to move at time T11 and is caused to move at an acceleration velocity 152 by the attraction as shown in FIG. 6(*d*). The contact 102 is closed at time T12 immediately before the movable iron core 1 collides with the fixed iron core 20 as shown in FIG. 6(*e*), and subsequently, the movable iron core 1 collides with the fixed iron core 20 at a low velocity at time T5. The acceleration of the movable iron core 1 is lost because the electromagnet current at time T4 is zero.

The length of time 154, between the current zero cross point 155 and the collision, is approximately 4 ms. According to experimental results, the length of time 154 is between 1 and 5 ms.

The actuation phase angle α may be set at any point between the current zero cross point and a point 1 to 5 ms before the movable iron core 1 collides with the fixed iron core 20. It should be noted that when setting the actuation phase angle α, if the current zero cross point is too close to time T5, the movable iron core 1 collides without its velocity decreasing. On the other hand, if the current zero cross point occurs too early, a backward current increases, which increases the attraction again and accelerates the movable iron core 1 again to increase the collision velocity.

Figures 7A, 7B, 7C, 7D:
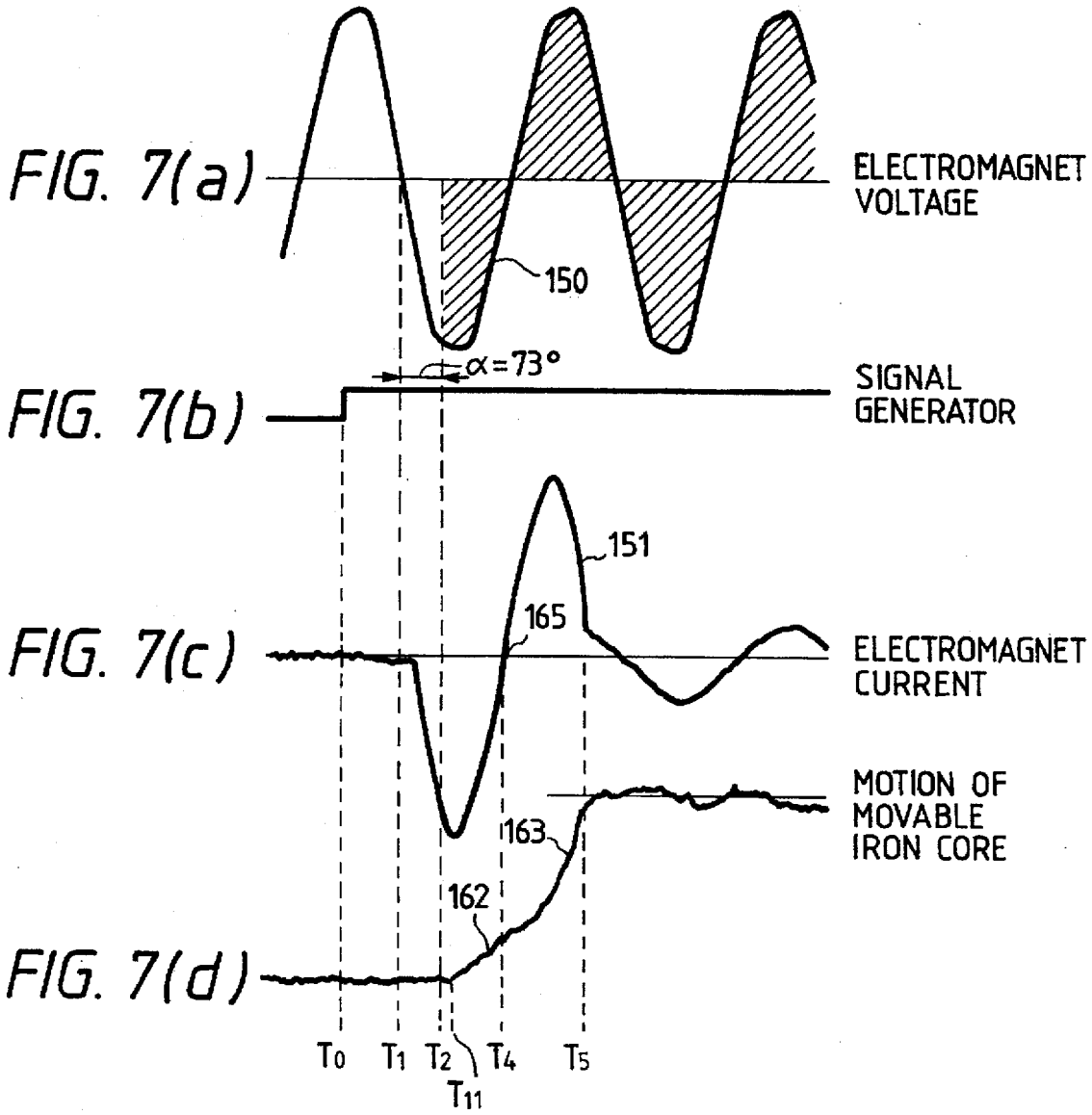
FIGS. 7(*a*)–7(*d*) illustrate actual waveform diagrams according to the present invention.

The actual operation waveform of the magnetic contactor set to an improper actuation phase angle will be described in accordance with FIGS. 7(*a*)–7(*d*), wherein the normally open contact 200 in the signal generator 104 is closed at time T0, as shown in FIG. 7(*b*), and the phase switch 103 is turned on at the actuation phase angle α of 73° to apply a hatched voltage 150 to the electromagnet 101, as shown in FIG. 7(*a*). When the voltage is applied to the electromagnet 101, a current 151 flows in the electromagnet 101, as shown in FIG. 7(*c*), to cause magnetic attraction, and the movable iron core 1 begins to move at time T11 and is caused to move at a relatively low acceleration velocity 162 as shown in FIG. 7(*d*). The movable iron core 1 moves past the current zero cross point 165 halfway, rapidly increases velocity 163 as the current increases, and collides against the fixed iron core 20 at time T5. As a result, the collision velocity of the movable iron core 1 is extremely high. Hence, a large sound is generated at the time of collision, making a remarkable difference as compared to the phase angle of 35 degrees.

Embodiment 3

Figures 8A, 8B, 8C:
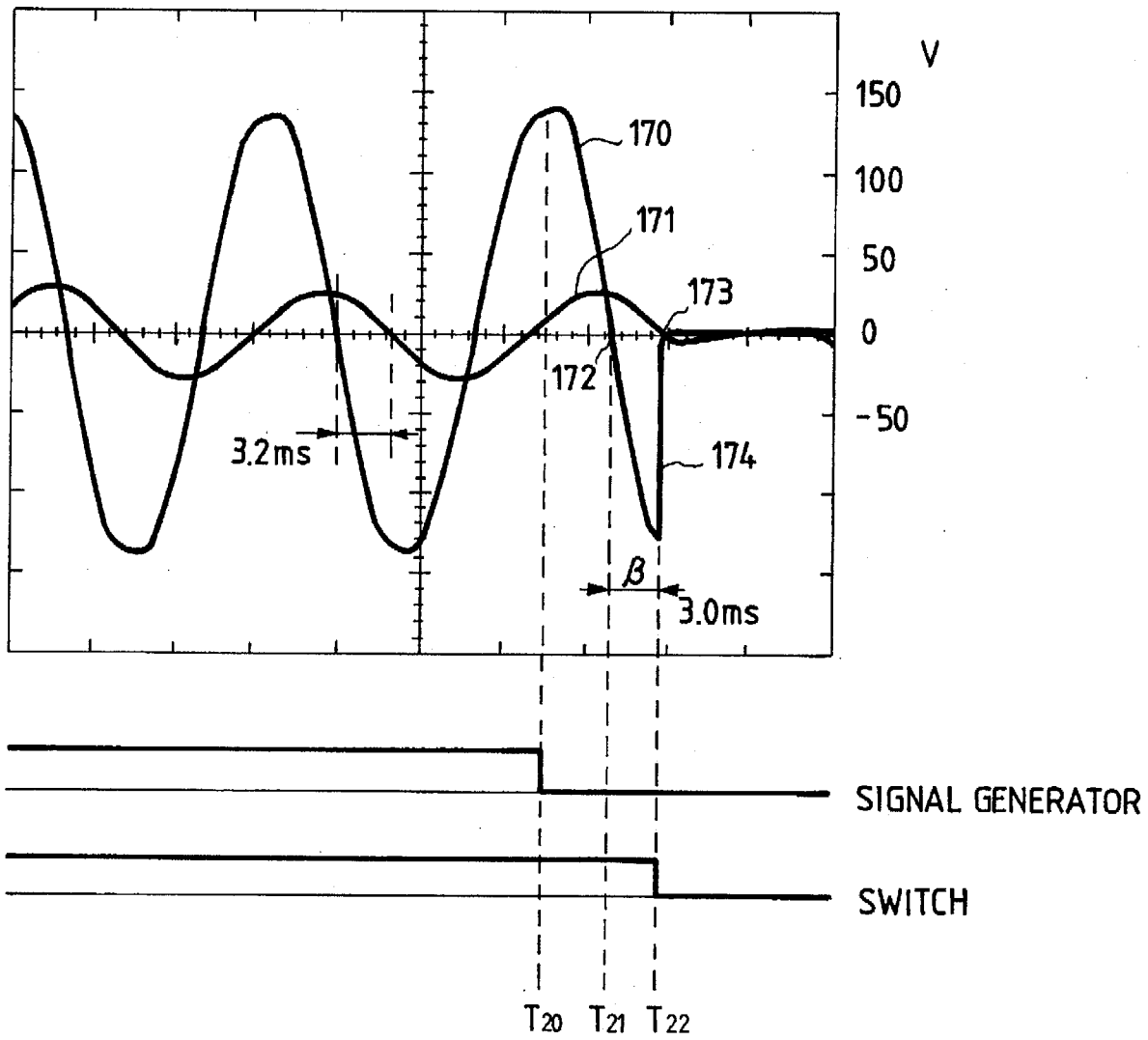
FIGS. 8(*a*)–8(*c*) illustrate actual waveform diagrams according to the present invention.

Another embodiment of the present invention will be described in accordance with FIGS. 8(*a*)–8(*c*), which illustrate waveform diagrams showing how the electromagnet 101 is de-energized. The normally open contact 200 in the signal generator 104 is closed as shown in FIG. 8(*b*), the phase switch 103 is turned on as shown in FIG. 8(*c*), and a voltage 170 is applied to the electromagnet 101 to start a current 171, as shown in FIG. 8(*a*). In the electromagnet 101, which is an equivalent circuit of an inductance and a resistor connected in series, the current 171 often lags the voltage 170 of the electromagnet 101 by the phase angle of 60 to 80 degrees. This is because the electromagnet 101 is designed to minimize power loss, and therefore, the inductance component is larger than the resistor component. In this example, the current lags the voltage by a phase angle of 67 degrees.

When the normally open contact 200 in the signal generator 104 is opened at time T20, as shown in FIG. 8(*b*), a next voltage zero cross point 172 is detected, and the phase switch 103 is turned off at time T22 with a delay of the phase angle β after time T21 at the voltage zero cross point 172, as shown in FIG. 8(*c*), to de-energize the electromagnet 101 at the current zero cross point.

Accordingly, since no energy is accumulated in the inductance of the electromagnet 101, a high voltage is not generated by de-energizing the electromagnet 101.

With no high voltage generated, the phase switch 103 consisting of semiconductors, etc., increases in reliability and noise generated by high voltages decreases.

Embodiment 4

Figure 9:
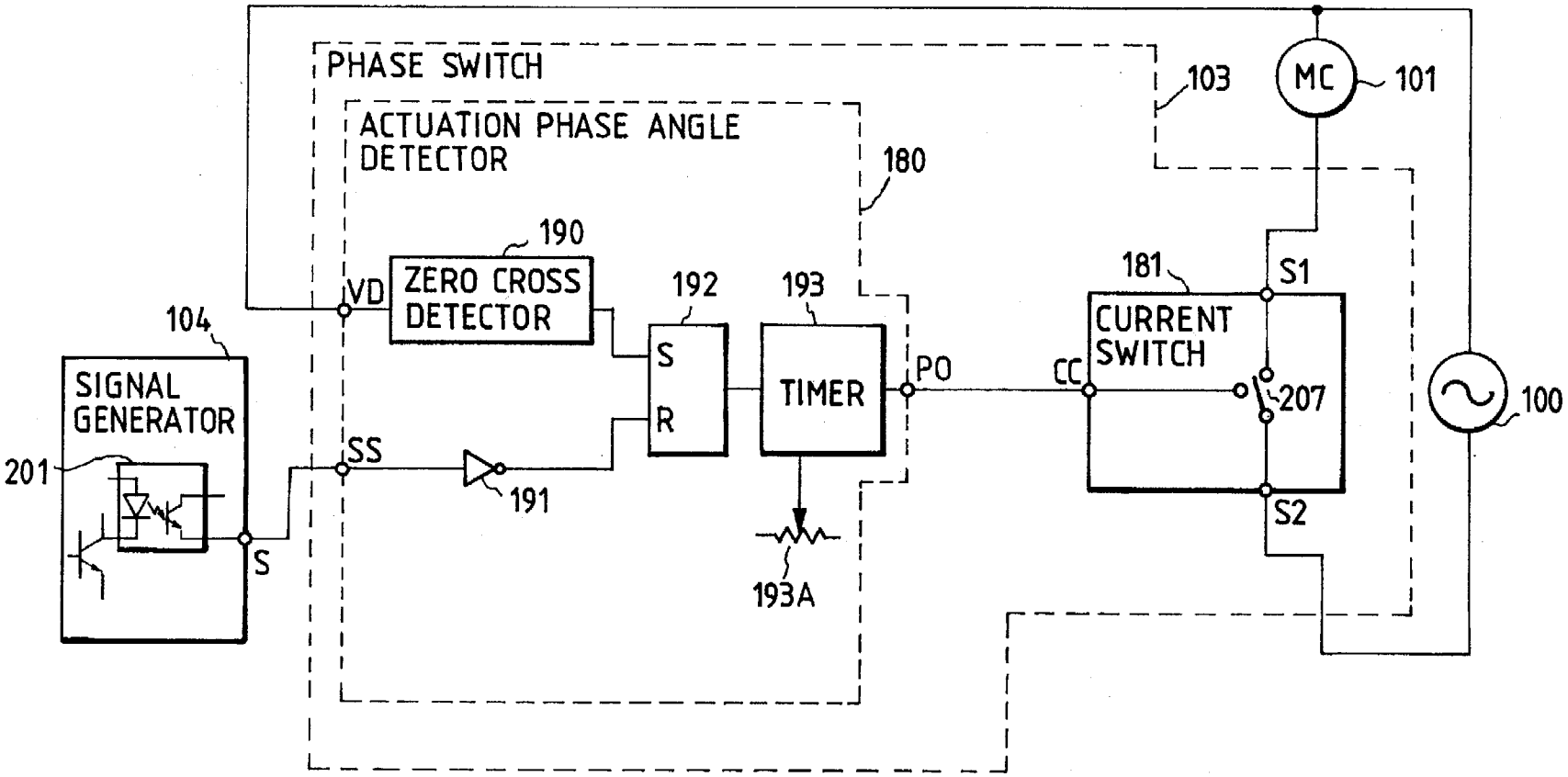
FIG. 9 is a circuit diagram showing another embodiment of the present invention.

Another embodiment of the present invention will be described in accordance with FIG. 9, wherein the electromagnet 101 is connected in series with the alternating-current power supply 100 via terminals S1 and S2 of a current switch section 181. One end of the electromagnet 101 and terminal VP of an actuation phase angle detector 180 are connected, and terminal SS of the actuation phase angle detector 180 is connected to terminal SD of the signal generator 104. The signal generator 104 generates the operation signal of the phase switch 103 by means of a photocoupler 201. Further, the phase switch 103 is comprised of the actuation phase angle detector 180 and the current switch section 181, which can be electrically opened and closed, and they are connected to each other at terminals PO and CC. The current switch section 181, e.g., a transistor or an FET (field-effect transistor), is designed to open or close an electric switch 207 or switch device under the control of an input signal.

In the actuation phase angle detector 180, the output of an invertor device 191, for inverting the output signal of the signal generator 104, is connected to the reset terminal of storage device 192, and the output of a zero cross detector 190, for detecting the zero cross of the voltage of the alternating-current power supply 100, is connected to the set terminal of the storage device 192. The output of the storage device 192, consisting of flip-flops, etc., is connected to the input of timer 193 which delays the signal output by the storage device 192 by a given length of time as a phase adjusting means. This timer 193 allows the delay time to be adjusted by a variable resistor 193A. In this example, the timer is a delay device or the like configured by an on-delay timer or a time-constant circuit made up of a resistor and a capacitor.

The operation of the present embodiment will be described in accordance with FIG. 9. An ON signal is generated via the photocoupler 201 of the signal generator 104 and inverted by the invertor device 191 to cancel the reset of the storage device 192. The zero cross detector 190 detects the zero voltage of the alternating-current power supply 100 and generates an output signal. This output signal is supplied by the timer 193, a given time later, as an ON signal to the current switch section 181. Accordingly, the current switch section 181 turns on at a given actuation phase angle to energize the electromagnet 101. By setting the delay time of the timer 193 at the phase angle at which the current switch section 181 turns on, the magnetic contactor can be set to the actuation phase angle at which the collision velocity decreases.

Embodiment 5

Figure 10:
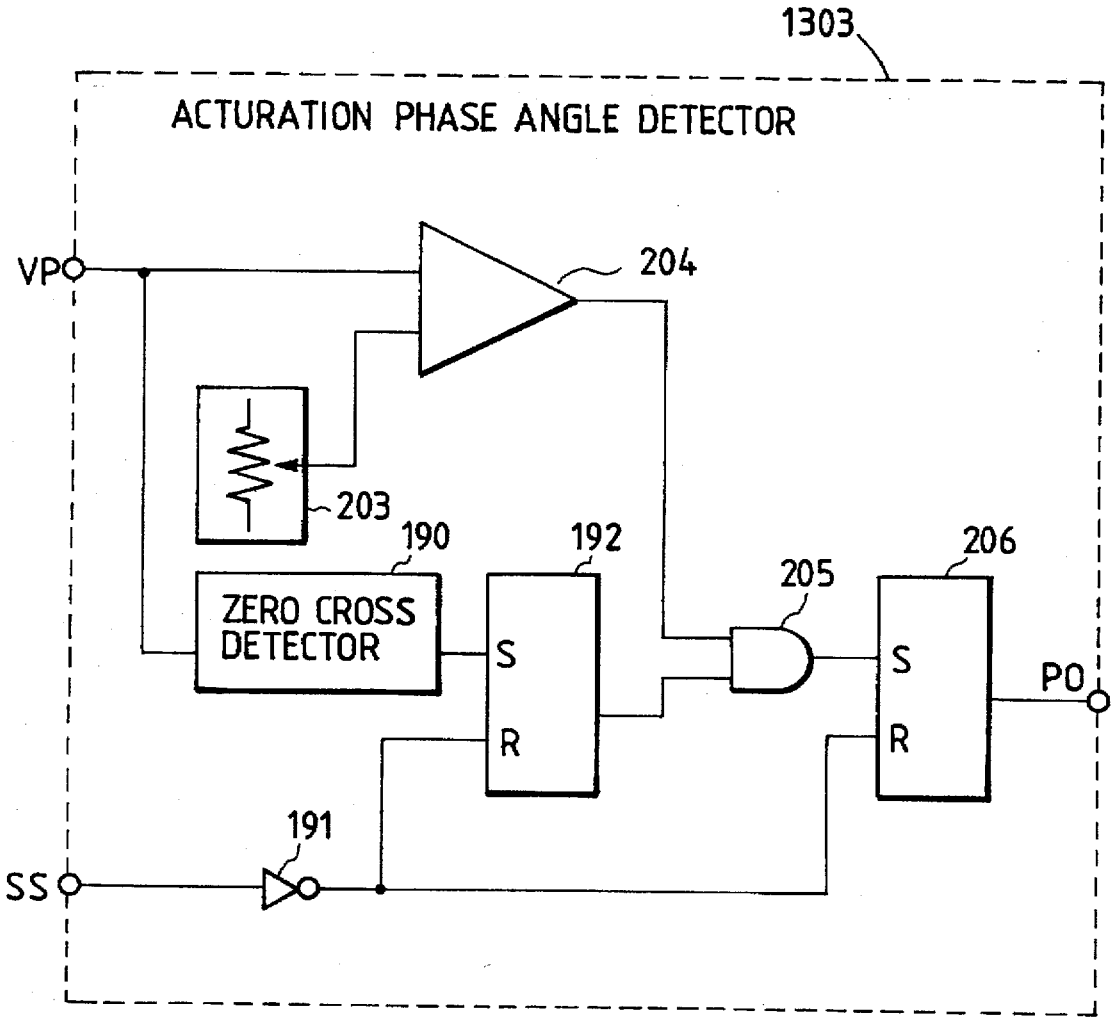
FIG. 10 is a circuit diagram showing another embodiment of the present invention.

Another embodiment of the actuation phase angle detector will be described in accordance with FIG. 10, wherein terminal SS of an actuation phase angle detector 180B is connected to the input of the invertor device 191, which inverts an external signal supplied to terminal SS. The output of the invertor device 191 is connected to the reset terminals of the storage devices 192, 206 consisting of flip-flops, etc., to cancel the resets of the storage devices 192, 206 under the control of an ON signal. Terminal VP, connected to the alternating-current power supply, is connected to one input of a comparator 204 and the input of the zero cross detector 190. The output of the zero cross detector 190 is connected to the set terminal of the storage device 192.

A setting potentiometer 203 is connected to the other input of the comparator 204. The setting potentiometer 203 is designed to set a reference voltage used for comparison with the voltage of the alternating-current power supply 100. The output of the comparator 204 and that of the storage device 192 are respectively connected to the inputs of an AND device 205, and the output of the AND device 205 is connected to the set terminal of the storage device 206.

The operation of the present embodiment will be described in accordance with FIG. 10. An external ON signal is entered into terminal SS and inverted by the invertor device 191 to cancel the reset of the storage devices 192, 206. Also, the voltage of the alternating-current power supply 100 is applied to terminal VP and the zero cross detector 190 detects that the voltage is zero and outputs a signal. If the reset of the storage device 192 has been canceled, the output signal sets the storage device 192. Subsequently, when the voltage of the alternating-current power supply 100 exceeds the voltage set to the setting potentiometer 203, the output of the comparator 204 is switched on. The output from the comparator 204 and the output ON signal of the storage device 192 are ANDed by the AND device 205, and the storage device 206 is set under the control of the output signal from the AND device 205. Accordingly, the storage device 192 is set at the zero cross point of the voltage of the alternating-current power supply 100 after the storage devices 192, 206 have been reset by the external ON signal. Further, the comparator 204 outputs a signal if the voltage of the alternating-current power supply 100 exceeds the voltage set to the setting potentiometer 203, whereby the storage device 206 is set by the output of the AND device 205, and an output signal is generated at the phase angle at which the alternating-current voltage corresponds to the voltage set to the setting potentiometer 203. Replacement of the actuation phase angle detector 180 in FIG. 9 with the actuation phase angle detector 180B described above allows the phase angle to be set by the setting potentiometer 203 as described in Embodiment 4, whereby the magnetic contactor, set to the actuation phase angle at which the collision velocity decreases, can be configured.

Embodiment 6

Figure 11:
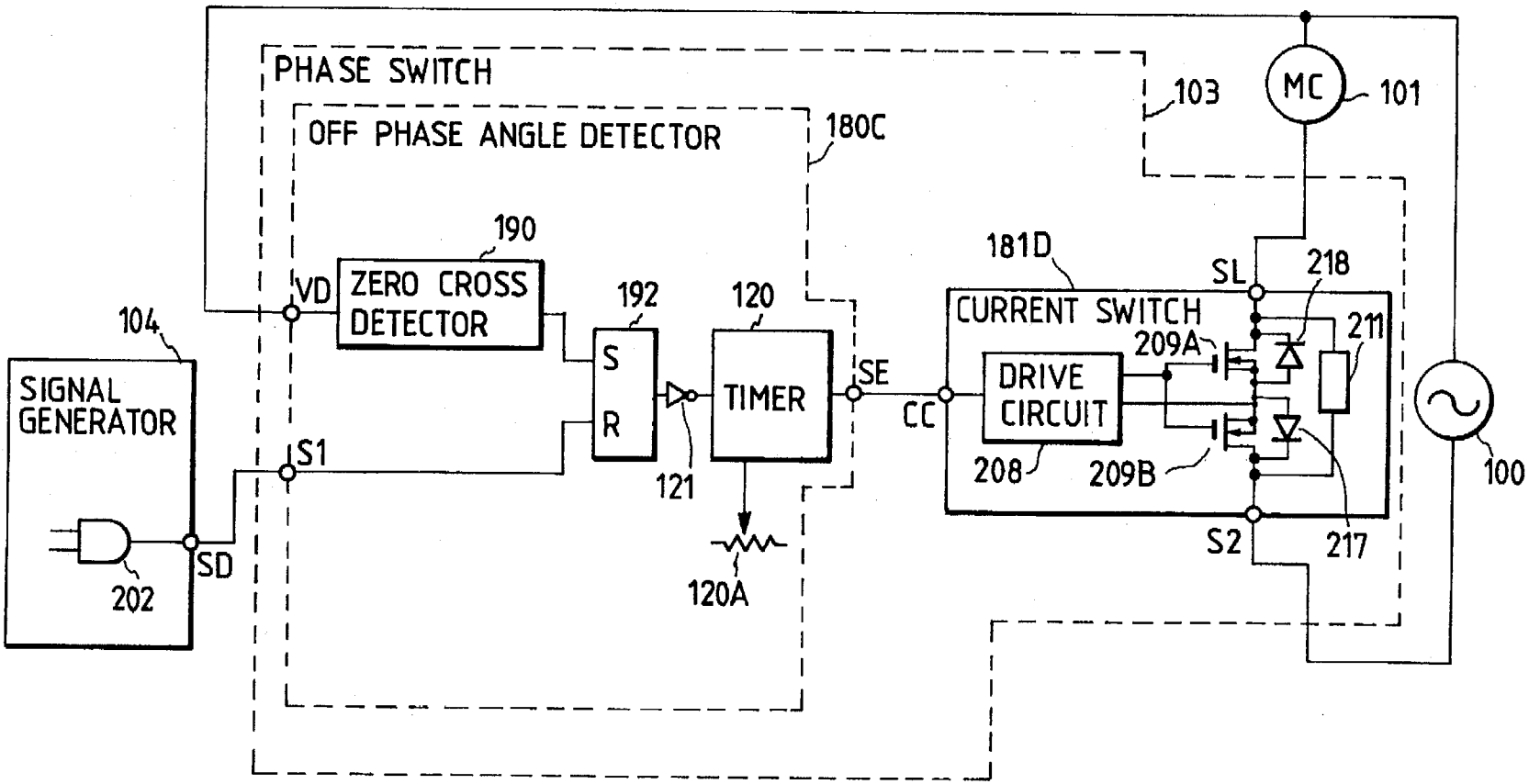
FIG. 11 is a circuit diagram showing an actuation phase angle detector of the present invention.

Another embodiment of the present invention will be described in accordance with FIG. 11, wherein the electromagnet 101 is connected in series with the alternating-current power supply 100 via terminals S1 and S2 of a current switch section 181B. One end of the electromagnet 101 and terminal VQ of an OFF phase angle detector 180C are connected together and terminal ST of the OFF phase angle detector 180C and terminal SD of the signal generator 104 are connected. This signal generator 104 generates the operation signal of the phase switch 103 by means of an AND device 202. Terminal SE of the OFF phase angle detector 180C and terminal CC of the current switch section 181B are connected.

In the OFF phase angle detector 180C, the output of the AND device 202 in the signal generator 104 is connected to the reset terminal of storage device 192, and the output of the zero cross detector 190, for detecting the zero cross of the voltage of the alternating-current power supply 100, is connected to the set terminal of the storage device 192. The output of the storage device 192, consisting of flip-flops, etc., is connected to the input of a timer 120 which delays the output signal a given time. The timer 120 allows the delay time to be adjusted by a variable resistor 120A. For example, the timer may be a delay device or the like configured by an on-delay timer or a time-constant circuit made up of a resistor and a capacitor. The output of the timer 120 is connected to the input of a drive circuit 208, and the outputs of the drive circuit 208 are respectively connected to the inputs of switching devices 209A and 209B, or switch means such as two FETs (field-effect transistors). The outputs of the switching devices 209A, 209B are connected in series with each other in opposite directions, diodes 216 and 217 are connected across the switching devices 209A and 209B, respectively, and a voltage absorbing device 211, for absorbing a high voltage, is connected between terminals S1 and S2.

The operation of the present embodiment will be described in accordance with FIG. 11. The AND device 202 in the signal generator 104 generates an ON signal and the output of the storage device 192 is off. The output of the invertor device 121 turns on, the timer supplies the ON signal to the input of the drive circuit 208 in a given period of time to provide the ON signal from the output of the drive circuit 208, whereby the switching devices 209A, 209B are turned on to energize the electromagnet 101.

Subsequently, the output of the AND device 202 in the signal generator 104 generates an OFF signal to cancel the reset of the storage device 192, and the zero cross detector 190 detects the zero voltage of the alternating-current power supply 100 and generates an output signal. This output signal is provided to switch on the output of the storage device 192, whereby the invertor device 121 inverts the OFF signal and the timer 193 outputs the OFF signal in a given period of time to send the OFF signal to the current switch section 181B. Accordingly, the current switch section 181B turns off at a given phase angle from the zero voltage point of the alternating-current power supply 100 to de-energize the electromagnet 101. By appropriately setting the delay time of the timer 120 at the phase angle at which the current switch section 181B turns off, the electromagnet 101 can be de-energized at the zero current of the electromagnet 101, whereby the magnetic contactor set to the phase angle at which high voltages are rarely generated can be configured.

Embodiment 7

Figure 12:
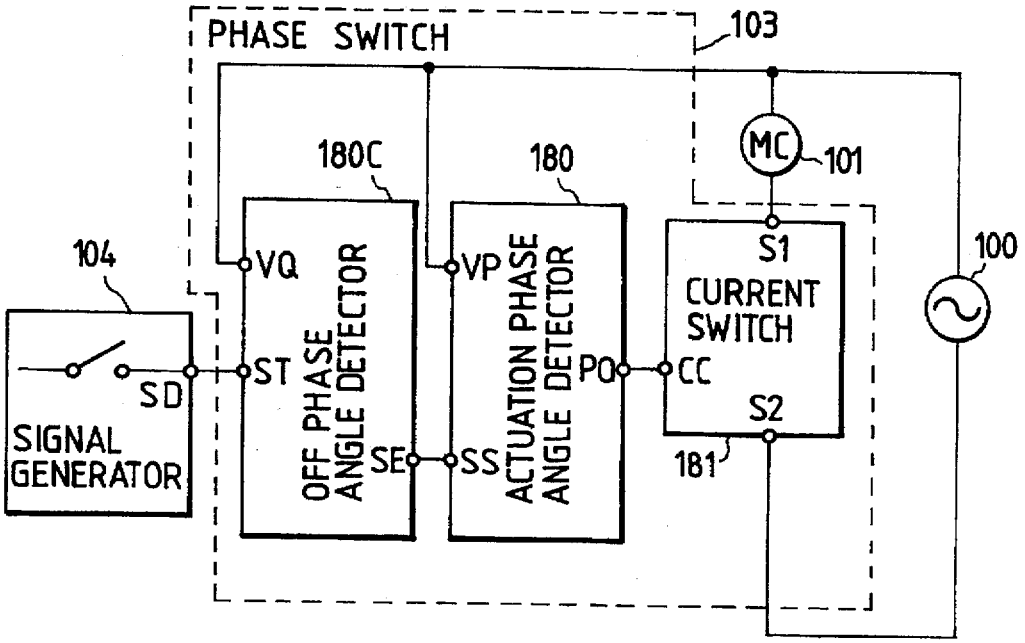
FIG. 12 is a circuit diagram showing another embodiment of the present invention.

Another embodiment of the present invention will be described in accordance with FIG. 12, wherein the electromagnet 101 and the alternating-current power supply 100 are connected in series with each other via terminals S1 and S2 of the current switch section 181 including a switch. Terminal ST of an OFF phase angle detector 180C is connected to terminal SD of the signal generator 104, and terminal VQ of the OFF phase angle detector 180C and terminal VP of the actuation phase angle detector 180, including a phase adjusting device, are connected to one end of the electromagnet 101. Terminal SE of the OFF phase angle detector 180C is connected to terminal SS of the actuation phase angle detector 180, and terminal PO of the actuation phase angle detector 180 is connected to terminal CC of the current switch section 181. It is to be noted that the actuation phase angle detector 180 is identical to the one illustrated in FIG. 10, and the OFF phase angle detector 180C is identical to the one illustrated in FIG. 11.

The operation of the present embodiment will be described in accordance with FIG. 12. First, the switch of the signal generator 104 is turned on to supply an ON signal to terminal ST of the OFF phase angle detector 180C. The OFF phase angle detector 180C generates the ON signal from terminal SE and the signal is supplied to terminal SS of the actuation phase angle detector 180. The actuation phase angle detector 180 detects that the voltage of the alternating-current power supply 100 is zero, generates the ON signal from its terminal PO in a given period of time, and supplies it to terminal CC of the current switch section 181 to turn on the current switch section 181, thereby energizing the electromagnet 101.

Subsequently, the switch of the signal generator 104 is turned off to supply an OFF signal to terminal ST of the OFF phase angle detector 180C, which then detects that the voltage of the alternating-current power supply 100 is zero. In a given period of time, the output of the OFF phase angle detector 180C is switched off, the OFF signal is supplied to terminal SS of the actuation phase angle detector 180 and is generated at terminal PO of the actuation phase angle detector 180 to turn off the current switch section 181, thereby de-energizing the electromagnet 101.

Embodiment 8

Figure 13:
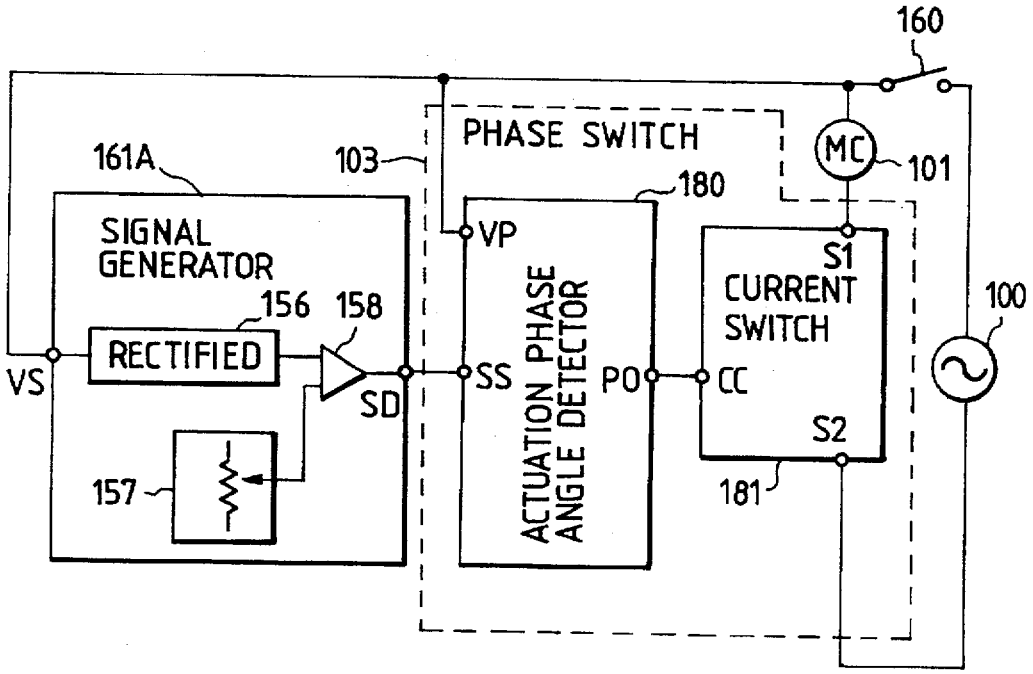
FIG. 13 is a circuit diagram showing another embodiment of the present invention.

Another embodiment of the present invention will be described in accordance with FIG. 13, wherein one end of the alternating-current power supply 100 is connected to one end of the electromagnet 101 via a switch 160, and the other end of the electromagnet 101 is connected to the other end of the alternating-current power supply 100 via terminals S1 and S2 of the current switch section 181. One end of the switch 160 is connected to terminal VS of a signal detector 161A and terminal VP of the actuation phase angle detector 180. Terminal SD of the signal detector 161A is connected to terminal SS of the actuation phase angle detector 180, and terminal PO of the actuation phase angle detector 180 is connected to terminal CC of the current switch section 181. The input of a rectifier 156 is connected to terminal VS of the signal detector 161A, and the output of the rectifier 156 is connected to one input of comparator 158. A setting potentiometer 157 sets a reference voltage for comparison with the voltage of the alternating-current power supply 100 by the comparator 158, and the output of the comparator 158 is connected to terminal SD.

The operation of the present embodiment will be described in accordance with FIG. 13. When the switch 160 is turned on, the voltage of the alternating-current power supply 100 is input to terminal VS of the signal detector 161A. If the voltage is higher than the voltage set to the setting potentiometer 157, the comparator 158 generates an ON signal at its output and supplies it to terminal SS of the actuation phase angle detector 180. The actuation phase angle detector 180 then detects that the voltage of the alternating-current power supply 100 supplied to terminal VP is zero. A given period of time after that detection, the actuation phase angle detector 150 supplies the ON signal to its terminal PO to turn on the current switch section 181, thereby energizing the electromagnet 101.

Embodiment 9

Figure 14:
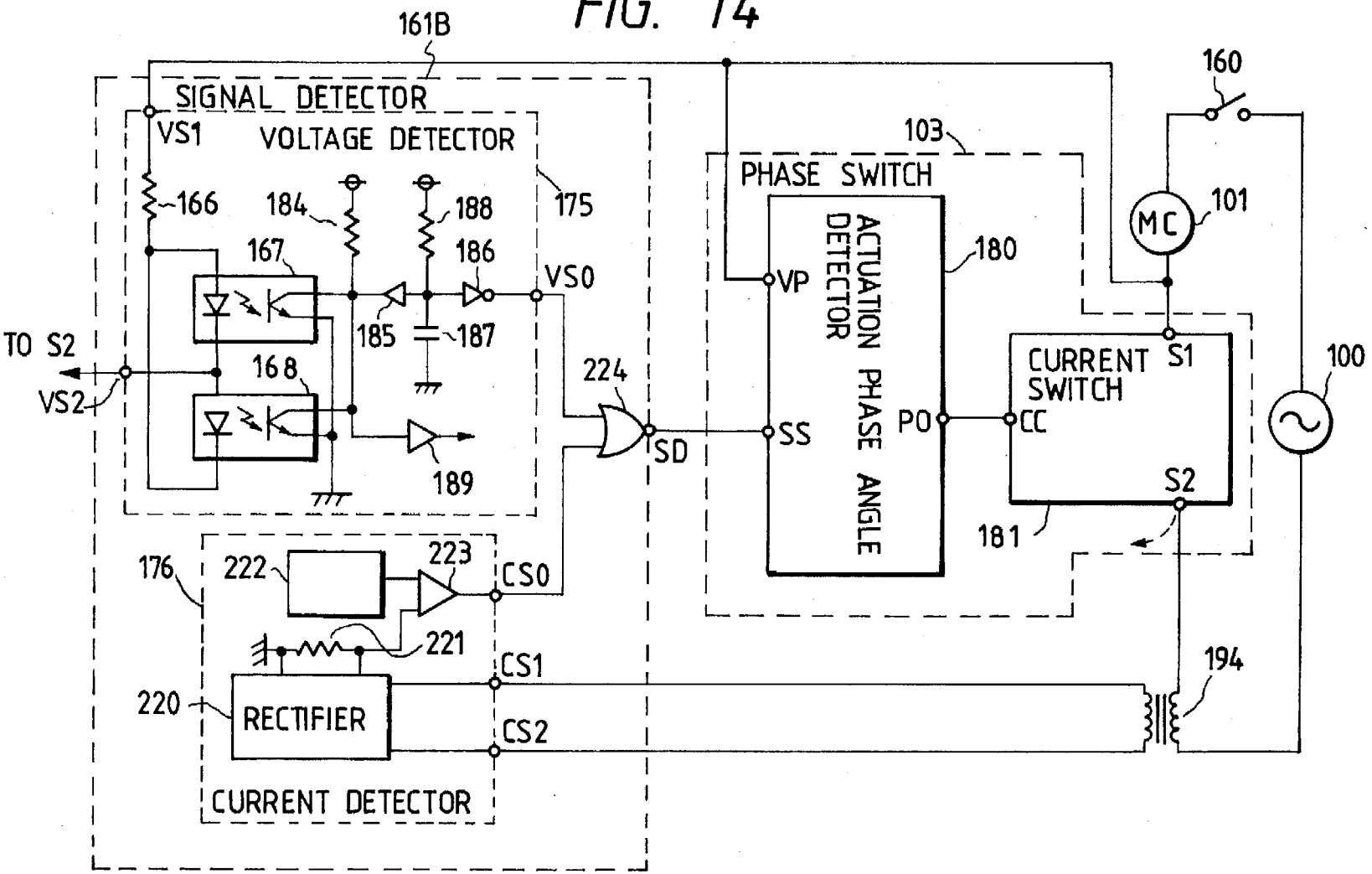
FIG. 14 is a circuit diagram showing another embodiment of the present invention.

Another embodiment of the present invention will be described in accordance with FIG. 14, wherein the other embodiment of the signal detector will be described. One end of the alternating-current power supply 100 is connected to one end of the electromagnet 101 via the switch 160, the other end of the electromagnet 101 is connected to one end of a current detector 194, such as a rectifier, via terminals S1 and S2 of the current switch section 181, and the other end of the current detector 194 is connected to the alternating-current power supply 100. One end of the switch 160 is connected to terminal VS1 of a voltage detector 175 and terminal VP of the actuation phase angle detector 180. Terminal S2 of the current switch section 181 is connected to terminal VS2 of the voltage detector 175. The output of the current detector 194 is connected to terminals CS1 and CS2 of the current detector 176. Terminal SD of the signal detector 161B is connected to terminal SS of the actuation phase angle detector 180, and terminal PO of the actuation phase angle detector 180 is connected to terminal CC of the current switch section 181. Terminal VS1 of the voltage detector 175 is connected across a series connection of the inputs of photocouplers 167 and 168 via a resistor 166. The emitters of the photocouplers 167, 168 are grounded, and the collectors of the photocouplers 167, 168 are connected in common to a signal power supply via a resistor 184, and also connected to the ends of a diode 185 and a buffer 189. Signal power is supplied to the diode 185, a capacitor 187 and an invertor device 186 via a resistor 188. The output of the invertor device 186 is connected to one input of an OR device 224. One end of capacitor 187, the input of a buffer 189, and a power source, via a resistor 188, are connected to the other end of a diode 185. The other end of the capacitor 187 is connected to ground. The output of the capacitor 187 is connected to the terminal VS0, which is connected to the input of the OR device 224. It is to be understood that the output of the buffer 189, which provides a pulse signal when a voltage across terminals VS1 and VS2 is zero, can be used as a zero cross detector.

A rectifier 220 is connected to terminals CS1 and CS2 of the current detector 176, a resistor 221 is connected to the output of the rectifier 220, and one end of the resistor 221 is grounded. The other end of the resistor 221 is connected to one input of comparator 223. The output of a setting potentiometer 222, used to set a given reference voltage, is connected to the other input of the comparator 223, and the output of the comparator 223 is connected to the input of the OR device 224.

The operation of the present embodiment will be described in accordance with FIG. 14. First, the switch 160 is turned on, a voltage is applied across terminals VS1 and VS2, a current flows via the resistor 166, the photocoupler 167 or 168 turns on every half period, the voltage of the capacitor 187 is discharged via the diode 185, the input of the invertor device 186 changes from High to Low, and the invertor device 186 inverts the input and generates a Low-to-High signal at its output. The invertor device 186 transmits an ON signal (High) to terminal SS of the actuation phase angle detector 180 via the OR device 224. Subsequently, the actuation phase angle detector 180 supplies the ON signal to terminal PO a given delay time after the zero cross point of the voltage of the alternating-current power supply 100 to turn on the current switch section 181. Hence, by appropriately setting the phase angle at which the current switch section 181 turns on, the magnetic contactor can be set to an actuation phase angle at which the collision velocity decreases.

Subsequently, the current switch section 181 causes a current to flow in the electromagnet 101, the voltage across terminals S1 and S2 is nearly zeroed, and the photocouplers 167, 168 turn off. The capacitor 187 is charged via the resistor 188 at a given time constant, and in a predetermined period of time, the input of the invertor device 186 changes from Low to High. In the meantime, within the predetermined period of time, the current detector 194 detects the current, the output of the current detector 194 is rectified by the rectifier 220, and a voltage is generated at the resistor 221. When the voltage reaches or exceeds the voltage of the setting potentiometer 222, an ON signal (High) is generated at the output of the comparator 223 and is input to terminal SS of the actuation phase angle detector 180 via the OR device 224. The ON signal is supplied to terminal PO to keep supplying the ON signal to terminal CC of the current switch section 181, whereby the current continues flowing in the electromagnet 101. Namely, although the voltage across terminals S1 and S2 is zeroed after the current switch section 181 has been turned on, current continues to flow, whereby the current of the electromagnet 101 is detected by the current detector 194 to keep the phase switch 103 on.

Embodiment 10

Figure 15:
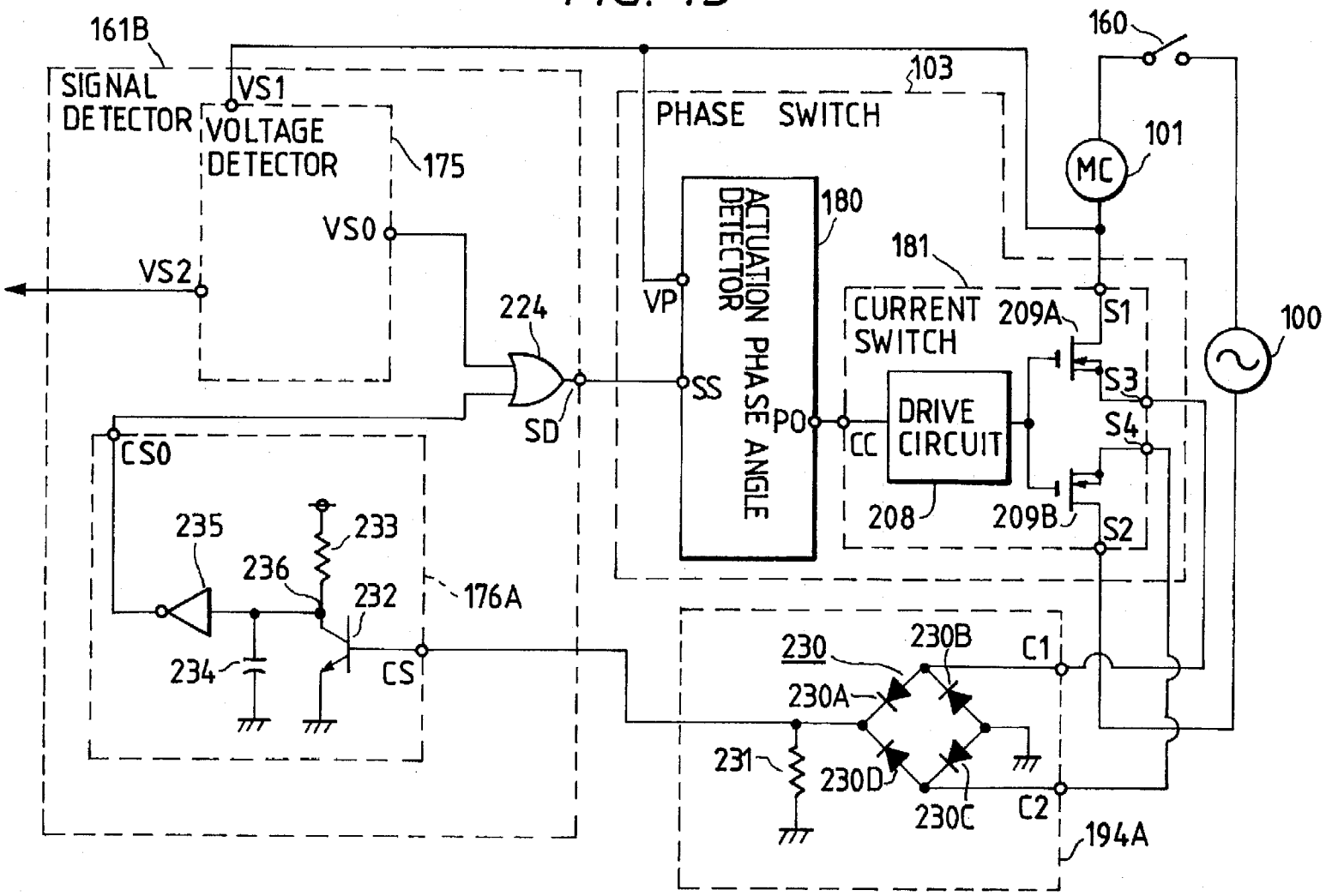
FIG. 15 is a circuit diagram showing a current detector of the present invention.

Another embodiment of the present invention will be described in accordance with FIG. 15. The current detector in FIG. 14 and another embodiment of the current detector will be described. Therefore, except the current detector 194A and the current detector 176A, the members are designated by the same numbers as in FIG. 14. In FIG. 15, the input of a rectifier 230 consisting of rectification devices 230A to 230D, is connected across the outputs of two switching devices 209A and 209B, the output of the rectifier 230 is connected to one end of the resistor 231, and the other end of the resistor 231 and one output of the rectifier 230 are grounded. It is to be understood that the rectifier 230 and the resistor 231 constitute the current detector 194A. One end of the resistor 231 is connected to terminal CS of the current detector 176A. The input of a switching device 232 is connected to terminal CS, the collector of the switching device 232 is connected to the signal power supply via a resistor 219, and the emitter of the switching device 232 is grounded. The input of an invertor device 235 and one end of a capacitor 234 are connected to a connection point 236 of the resistor 233, and the other end of the capacitor 234 is grounded. The capacitor 234 functions to keep the signal of the invertor device 235 unchanged at the zero cross point of the current of the alternating-current power supply.

The operation of the present embodiment will be described in accordance with FIG. 15. Now, when the switching devices 209A, 209B turn on to cause a current to flow in the rectifier 230, the rectifier 230 rectifies the current and the resistor 231 generates a voltage. The voltage is supplied to the input of the switching device 232 and the switching device 232 turns on to change the voltage at the connection point 236 from High to Low. The voltage at the connection point 236 is supplied to the invertor device 235 and the output of the invertor device 235 changes from Low to High. This change causes the flow of the current in the electromagnet 101 to be detected. Namely, when the current at or higher than a given value flows in the switching devices 209A, 209B, the signal of the invertor device 235 changes.

Embodiment 11

Figure 16:
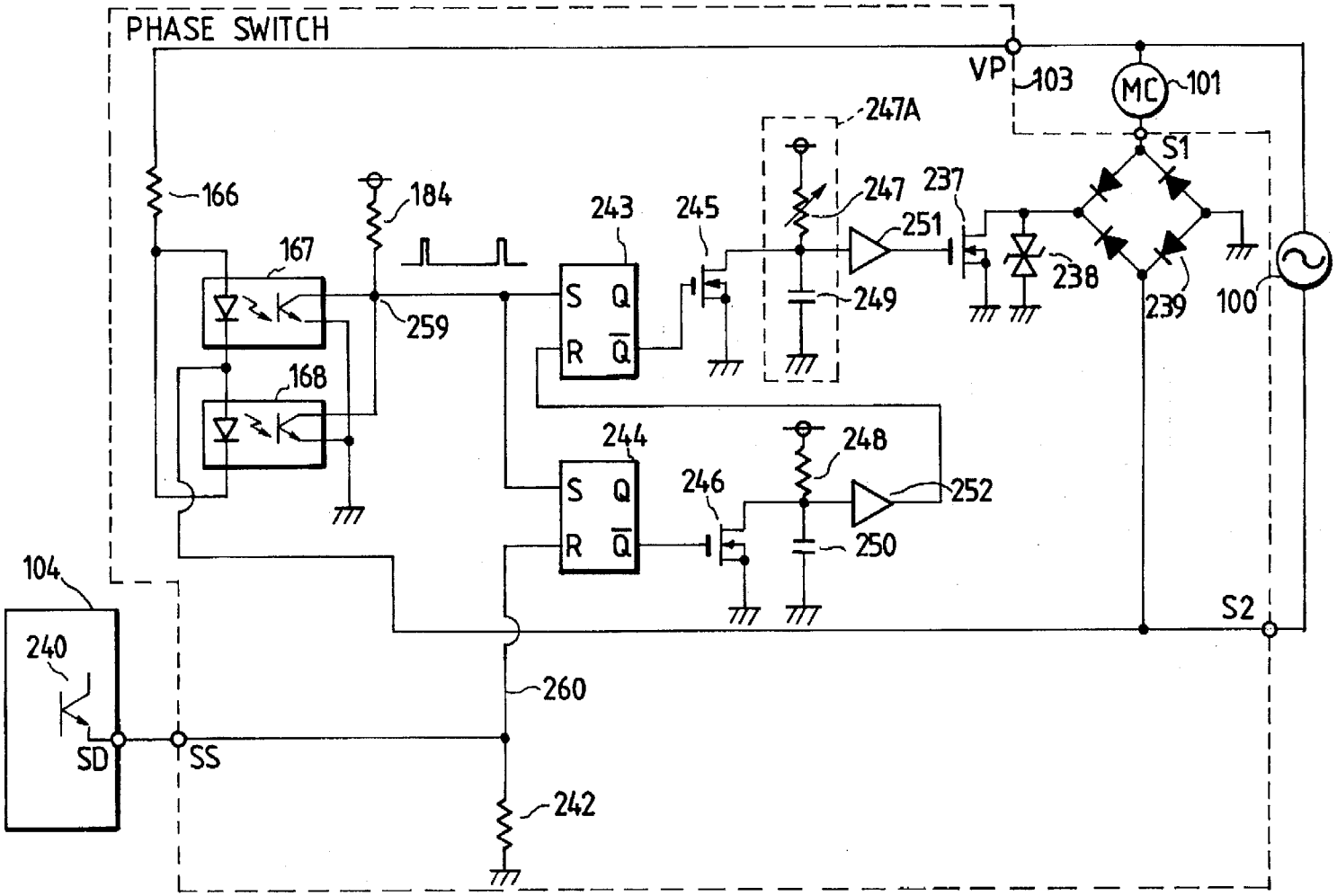
FIG. 16 is a circuit diagram showing the other embodiment of the present invention.

Another embodiment of the present invention will be described in accordance with FIG. 16, wherein the electromagnet 101 is connected to the alternating-current power supply 100 via terminals S1, S2 of the phase switch 103. Terminal VP of the phase switch 103 and one end of the electromagnet 101 are connected, and terminal SD of the signal generator 104 and terminal SS of the phase switch 103 are connected.

The operation of the present embodiment will be described in consideration of its structure. The voltage of the alternating-current power supply 100 is applied to the photocouplers 167, 168 via the resistor 166 to cause a current to flow in the photocouplers 167, 168 alternately per half period. A pulse is output to a connection point 259 of the outputs of the photocouplers 167, 168 as shown in FIG. 16, at the zero voltage point of the alternating-current power supply 100. When the signal generator 104 generates an ON signal, the voltage of the resistor 242 switches from Low to High to reset the storage device 244. Therefore, the output $\overline{Q}$ of the storage device 244 switches High, an FET 246 turns on, the output of a buffer 252 switches from High to Low to cancel the reset of storage device 243. Hence, the voltage pulse of the connection point 259 is input to the set terminal of the storage device 243, and the output $\overline{Q}$ of the storage device 243 switches from High to Low to turn off the FET 245. This causes the voltage of the capacitor 249 to rise at a time constant determined by the resistor 247 and capacitor 249, whereby in a given period of time, the output of the buffer 251 changes from Low to High to turn on the FET 237, and the rectifier 239 causes a current to flow in the FET 237 to energize the electromagnet 101.

Accordingly, when the signal generator 104 is on, the electromagnet 101 is energized with a delay determined by the resistor 247 and capacitor 249 after the zero cross point of the voltage of the alternating-current power supply 100. In other words, the electromagnet 101 is energized at a given actuation phase angle. By selecting the actuation phase angle appropriately by a phase adjusting device 247A, a magnetic contactor with reduced actuation impact can be provided.

When the signal generator 204 is off, the voltage of the resistor 242 is switched Low, the reset signal of the storage device 244 is canceled, the storage device 244 is set by the zero cross pulse of the output voltage of the photocoupler 167, 168, and the output $\overline{Q}$ of the storage device 244 switches from High to Low to turn off the FET 246. The capacitor 249 is charged via the resistor 247, the voltage of the capacitor 249 rises, and in a predetermined length of time, the output of the buffer changes from Low to High. Accordingly, the storage device 243 is reset, and its output $\overline{Q}$ switches from Low to High to turn the FET 245 on. The input/output of the buffer 251 changes from Low to High similarly to turn the FET 237 off. By appropriately setting the time constant of the time constant circuit consisting of the resistor 247 and the capacitor 249, the current of the electromagnet 101 can be shut off at zero.

Embodiment 12

Figure 17:
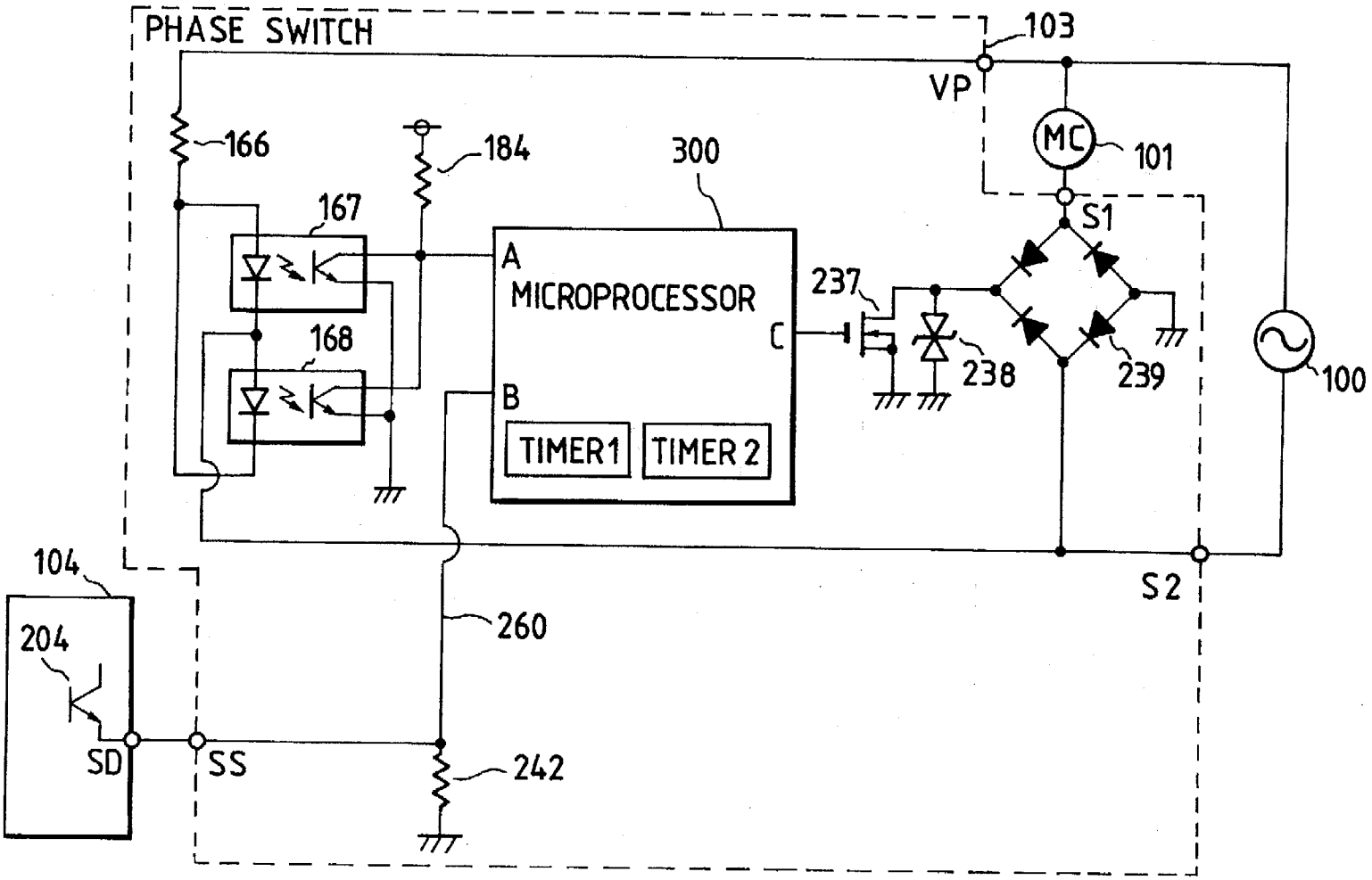
FIG. 17 is a diagram showing an embodiment wherein a microprocessor is used.

Another embodiment of the present invention will be described in accordance with FIG. 17, wherein an integrated circuit having arithmetic functions, e.g., a microprocessor or a digital processor, is used in the control section of the phase switch 103. The functions of the microprocessor 300 are utilized to provide the circuit with storage device, timer, digital arithmetic, etc. Terminal A of the microprocessor 300 is connected to one end of the resistor 184, terminal B of the same is connected to the resistor 242, and terminal C of the same is connected to the input of the FET 237.

Figure 18:
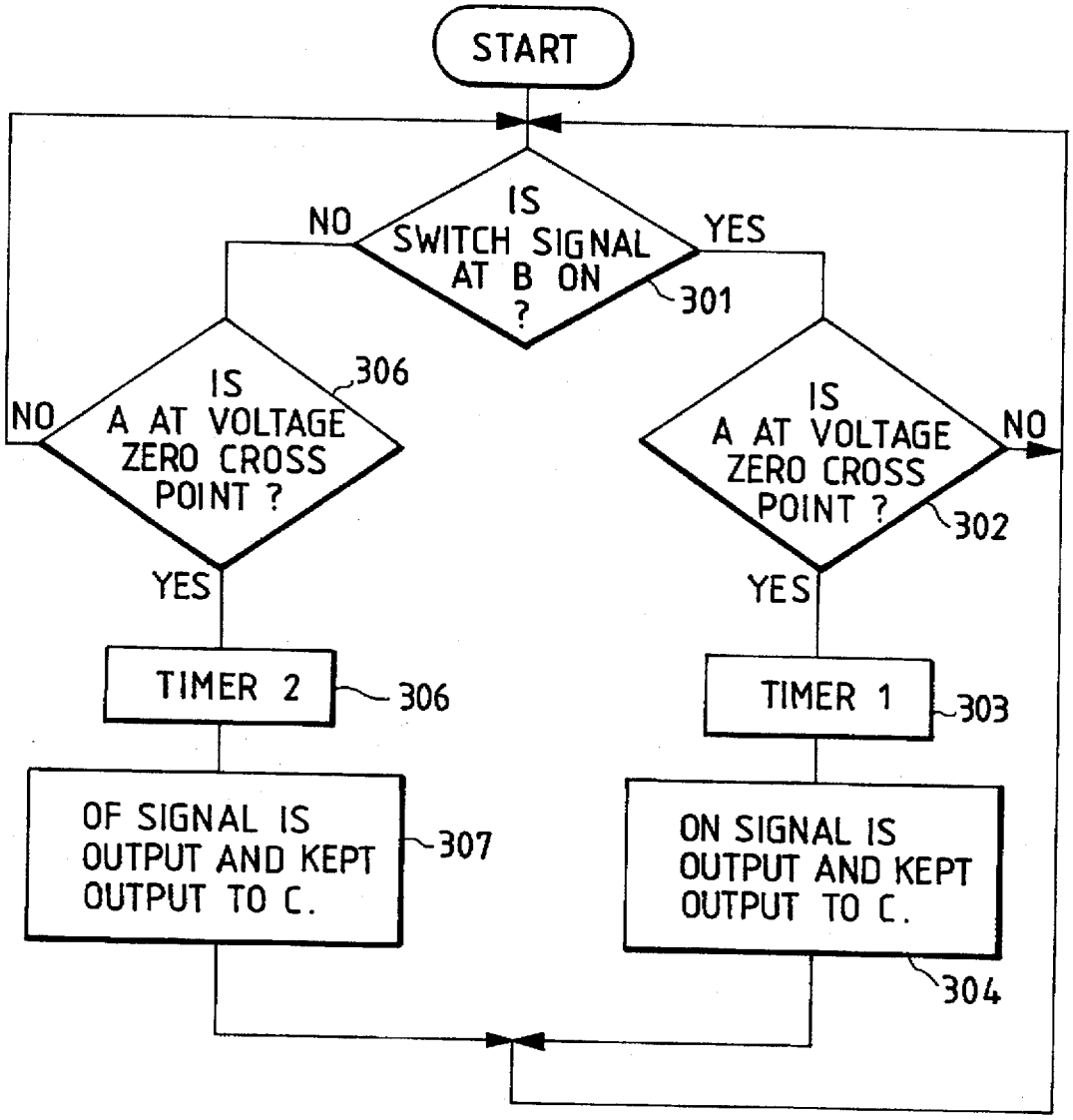
FIG. 18 is a flowchart illustrating the operation of the microprocessor in FIG. 17.

The operation of the present embodiment will be described in accordance with a flowchart in FIG. 18. First, the voltage of the resistor 242 connected to terminal B of the microprocessor 300 is checked to see whether the signal generator 104 is on or not (step 301). If it is on, there is a waiting time until the voltage of terminal A of the microprocessor 300 reaches the zero cross point (step 302), then there is a waiting time set to timer 1 (step 303), and the ON signal is output to terminal C of the microprocessor 300 (step 304). Meanwhile, if the signal generator 104 is off, there is a waiting time until the voltage of terminal A of the microprocessor 300 reaches the zero cross point (step 305), then there is a waiting time set to timer 2 (step 306), and the OFF signal is output to terminal C of the microprocessor 300 (step 307). It is to be understood that the times set to the timers 1 and 2 are equivalent to a length of time (phase angle) starting at the zero cross point of the voltage of the alternating-current power supply 100. Therefore, by setting the time of timer 1 to a value at which the collision velocity is low, a magnetic contactor with reduced actuation impact can be provided. Also, by setting the time of the timer 2 to a value at which the current of the electromagnet 101 is shut off at zero, a magnetic contactor for suppressing the occurrence of a high voltage can be provided. Also, by using a single-chip microprocessor or the like, a low-cost control section can be configured by a small integrated circuit. Software (especially timer values) may only be required to change for use with various magnetic contactors, and production is easy. Further, since an integrated circuit can be employed as a high-voltage, high-power control section recently, the use of an integrated circuit including the FET 237, the diode 239, a high voltage absorbing circuit 238, etc., and having an isolation function in place of the photocouplers 167, 168 achieves a compact, low-cost control circuit.

Embodiment 13

Figure 19A:
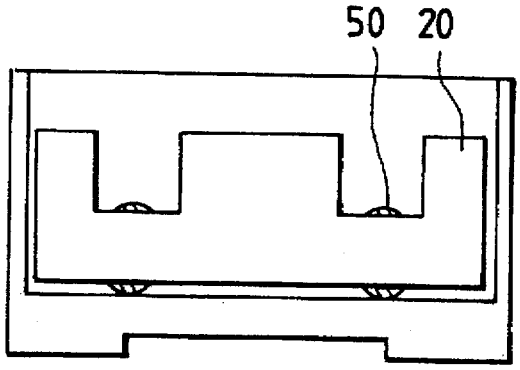
FIGS. 19(*a*)–19(*b*) illustrate diagrams showing an impact cushioning device.
Figure 19B:
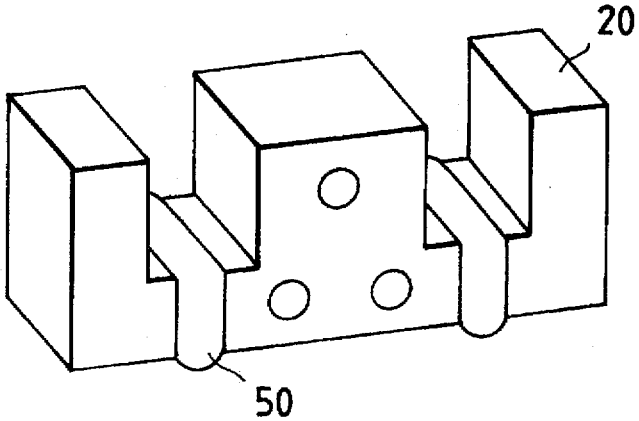
Figures 20A, 20B, 20C:
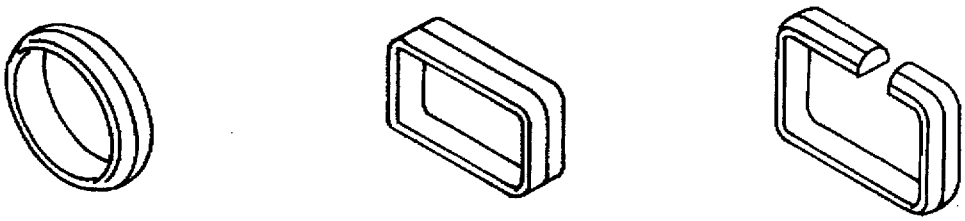
FIGS. 20(*a*)–20(*c*) illustrate perspective views showing elastic bodies.

Another embodiment of the present invention will be described in accordance with FIGS. 19(*a*)–19(*b*) and FIGS. 20(*a*)–20(*c*). In FIGS. 19(*a*) and 19(*b*), 50 indicates elastic bodies made of rubber, for example. The elastic bodies 50 are available in circular shape as shown in FIG. 20(*a*), rectangular shape illustrated in FIG. 20(*b*), and partly cut rectangular shape illustrated in FIG. 20(*c*). The elastic bodies 50 are fitted around the bottom of the fixed iron core 20. It is to be understood that the elastic bodies 50 work like the conventional rubber plate 22.

Embodiment 14

Another embodiment of the present invention will be described in accordance with FIGS. 21(*a*)–21(*b*), wherein a drive circuit 258 is contained within the mount 23 and secured integrally by resin pouring, etc. Meanwhile, two elastic bodies 50 are fitted around the bottom of the fixed iron core 20. The bobbins 24 are loaded to press the fixed iron core 20 via the elastic bodies 50.

Figure 21A:
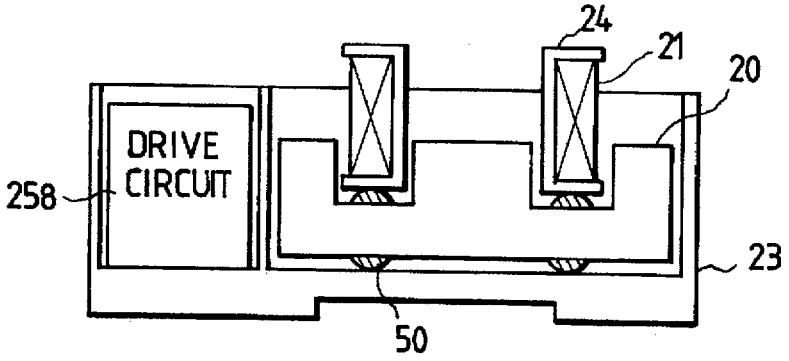
FIGS. 21(*a*)–21(*b*) are diagrams showing an impact cushioning device.
Figure 21B:
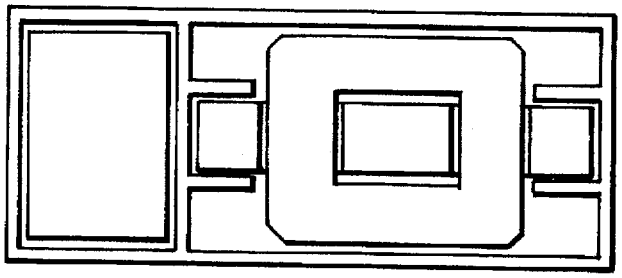

It is to be understood that FIG. 21(*a*) gives an example wherein the drive circuit 258 is integrally contained in the mount 23, however, the position of the drive circuit 258 is not limited to this position. Accordingly, the drive circuit 258 may be installed on the side face or bottom of the mount 23 or independently of the mount 23. Assembly performance is improved because of the integral fitting of the elastic bodies 50 around the bottom of the fixed iron core 20.

Embodiment 15

Figure 22:
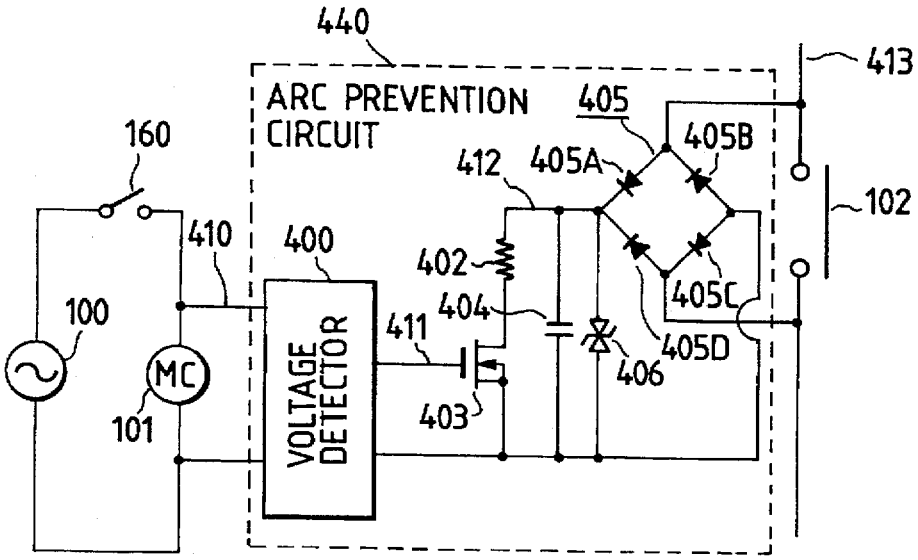
FIG. 22 is a circuit diagram showing an embodiment for preventing arc discharges at a contact.

Another embodiment of the present invention will be described in accordance with FIG. 22, which shows an embodiment designed to prevent the occurrence of arc discharges at the contacts of the magnetic contactor. In FIG. 22, the alternating-current power supply 100, the switch 160 and the electromagnet 101 are connected in series. Both ends of the electromagnet 101 are respectively connected to the inputs of the voltage detector 400. The output of the voltage detector 400 is connected to the input of a switching device 403, and a resistor 402 is connected to one output of the switching device 403. A capacitor 404 and a high voltage absorbing device 406 are connected in parallel with each other across the other output of the switching device 403 and the other end of the resistor 402. In the meantime, the input of a rectifier 405, consisting of rectification devices 405A to 405D, is connected in parallel with the contact 102, and the output of the rectifier 405 is connected to the capacitor 404, diode 40 and resistor 402.

An arc prevention circuit 440 includes a voltage detector 400, as shown by the dotted lines.

Figures 23A, 23B, 23C, 23D, 23E, 23F, 23G:
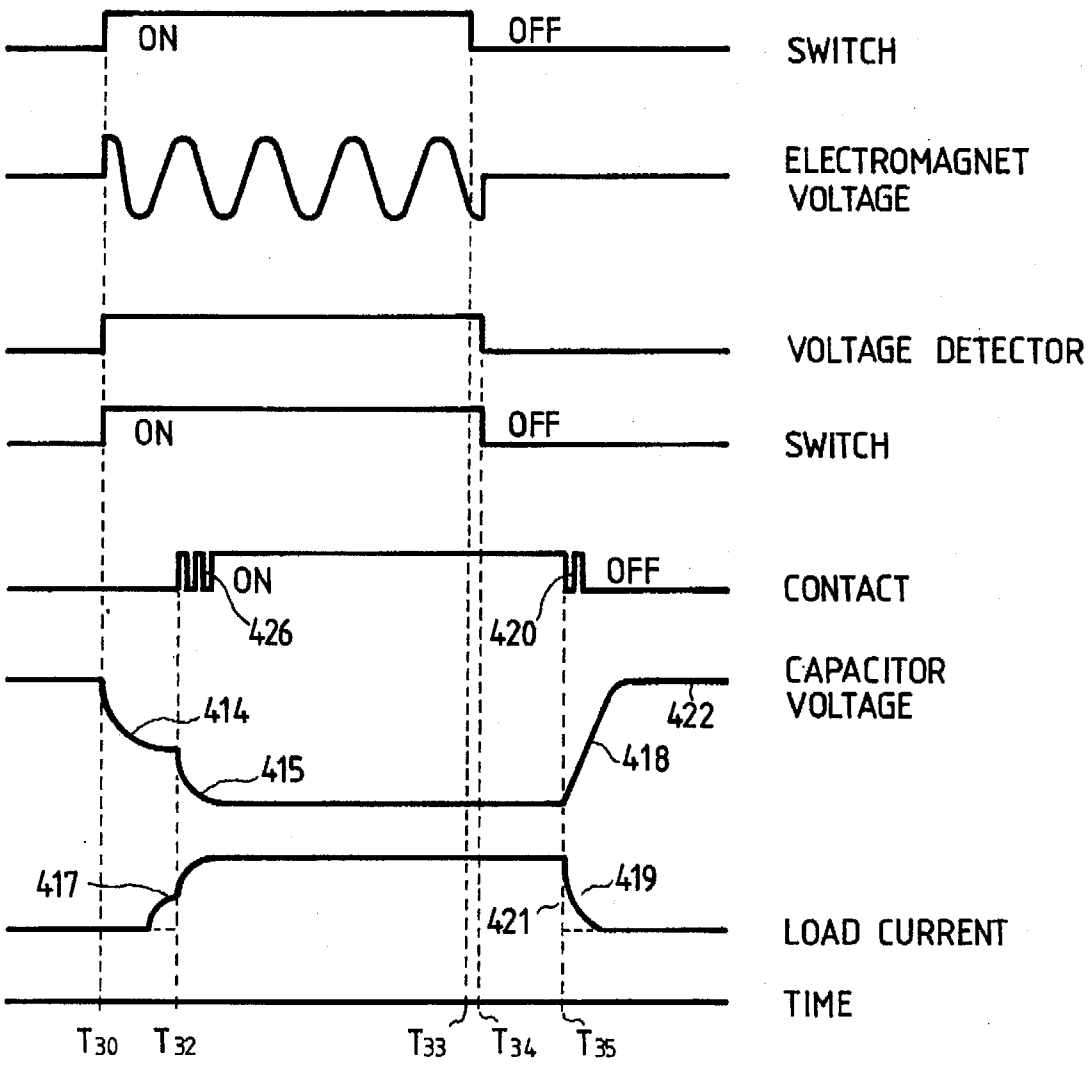
FIGS. 23(*a*)–23(*g*) show timing charts illustrating the operation of the device in FIGS. 21(*a*)–21(*b*).

The operation of the present embodiment will be described in accordance with FIGS. 23(*a*)–23(*g*). When the switch 160 is turned on at time T30 as shown in FIG. 23(*a*), the voltage of the alternating-current power supply 100 is applied to the electromagnet 101 as shown in FIG. 23(*b*). The voltage detector 400 detects the voltage of the electromagnet 101 and generates an ON signal, as shown in FIG. 23(*c*), to turn on the switching device 403 at time T30 as shown in FIG. 23(*d*). The switching device 403 then causes the capacitor 404 to discharge through the resistor 402 to lower the voltage as indicated by curve 414. Also, since the contact 102 is closed at time T32 after the electromagnet 101 has been energized, the voltage of the capacitor 404 is further lowered as indicated by curve 415.

When closed, the contact 102 switches back and forth, which is called chattering 426. Before the contact 102 is closed, the switching device 403 has already turned on at time T30, whereby a current as indicated by curve 417, shown in FIG. 23(*g*), flows in a load circuit 413 via the rectifier 405A through the resistor 402. If chattering 426 occurs, therefore, no high voltage is generated across the contact 102, whereby arc discharges rarely occur.

The operation performed when the switch 160 is turned off will now be described. When the switch 160 is turned off at time T33 as shown in FIG. 23(*a*), the voltage of the electromagnet 101 is zeroed as shown in FIG. 23(*b*). Hence, the output of the voltage detector 170 is also switched off at time T34 as shown in FIG. 23(*c*), whereby the switching device 403 turns off at the same time as shown in FIG. 23(*d*). At this time, the contact 102 is closed, as shown in FIG. 23(*e*), and the capacitor 404 has already discharged. In a short while, the contact 102 opens at time T35 and the current that had been flowing in the load circuit 413 all flows to the rectifier 405A to charge the capacitor 404. Accordingly, the voltage of the capacitor 404 rises as indicated by a curve 418.

Since the capacitor 404 is charged at an abnormally high voltage at this time, the high voltage absorbing device 406 is connected to prevent the switching device 403 from being damaged. The current for charging the capacitor 404 decreases as indicated by curve 419 shown in FIG. 23(*g*). At this time, the voltage across the contact 102 varies in a manner similar to the curve 418 as shown in FIG. 23(*f*), and is therefore zero at time T35. If chattering 420 occurs, therefore, no arc discharge occurs across the contact 102. Also, the voltage rises almost constantly as indicated by curve 418 and the current 413 in the load circuit decreases rapidly as indicated by curve 419. Also, as this time, since the current of the contact 102 is zeroed immediately at time T35, as indicated by a dotted line 421 as shown in FIG. 23(*g*), the current consumption of the contact 102 when opened can be reduced. In the state of curve 422 where the capacitor 404 has been charged, the rectifier 405 is being shut off by a backward voltage and no current flows in the load circuit 413.

Figure 24:
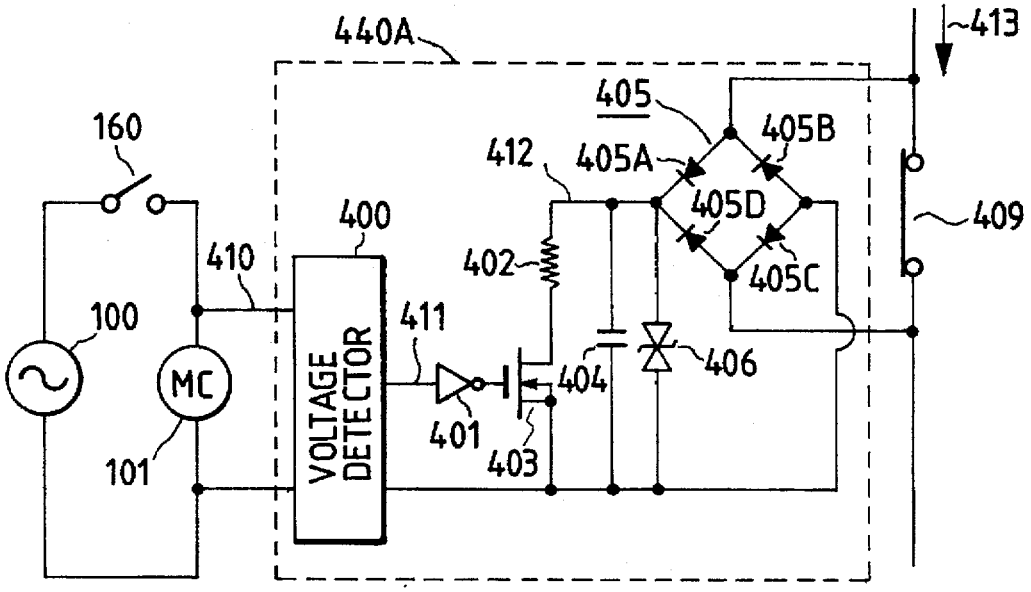
FIG. 24 is a diagram showing a contact arc prevention circuit where there is a normally closed contact.

Also, an example of using a normally closed contact 409 is shown in FIG. 24. 440A designates an arc prevention circuit. This example will not be described because the circuit shown in FIG. 24 is identical to the one in FIG. 22 with the exception that an input signal of an invertor device 401 is connected to an output signal 411 of the voltage detector 400 and an output of an invertor device 401 to the switching device 403.

Figure 25:
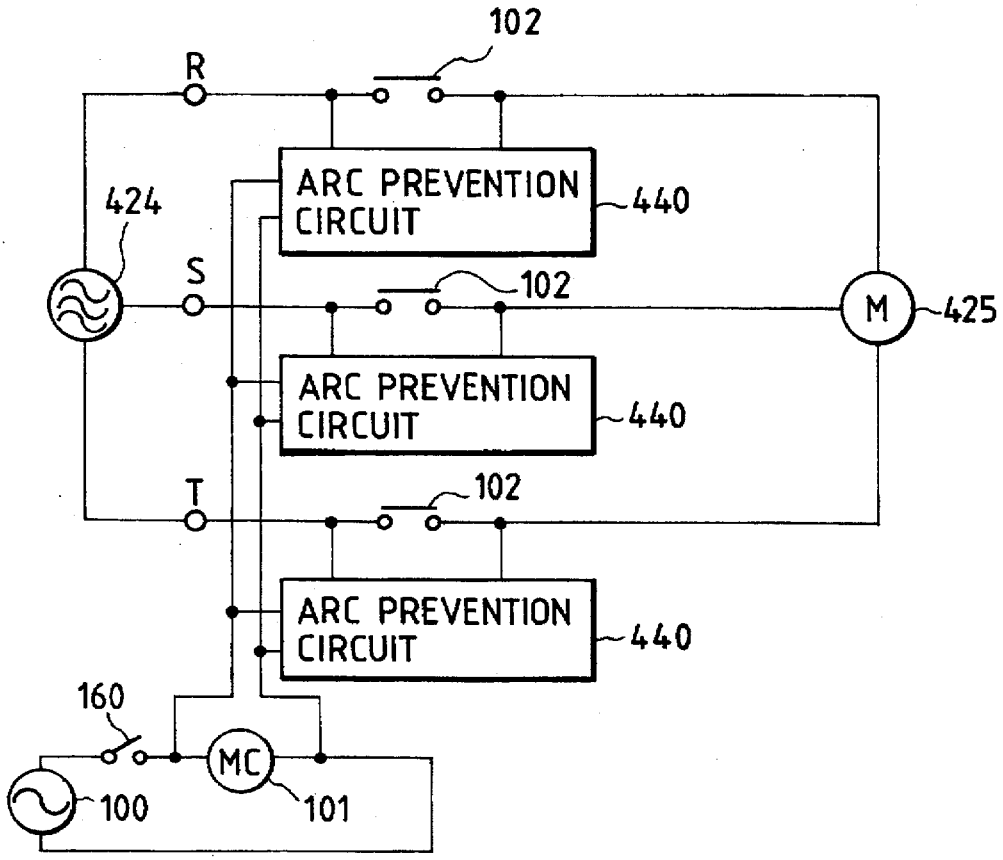
FIG. 25 is a diagram showing a contact arc prevention circuit where there is a three-phase alternating-current power supply.
Figure 26:
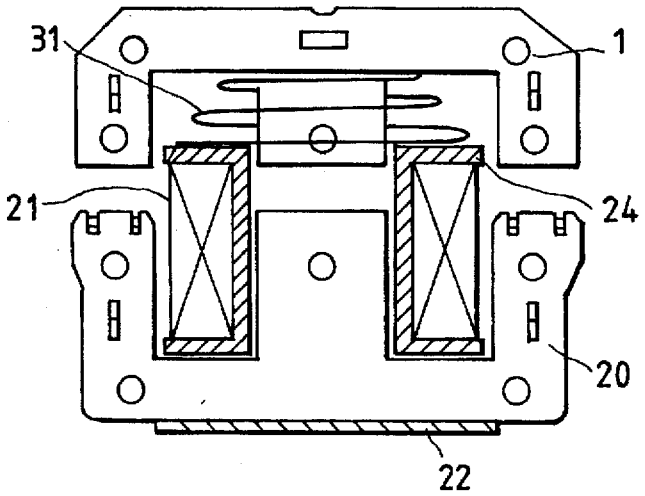
FIG. 26 is a sectional view showing the structure of a conventional magnetic contactor.
Figure 27A:
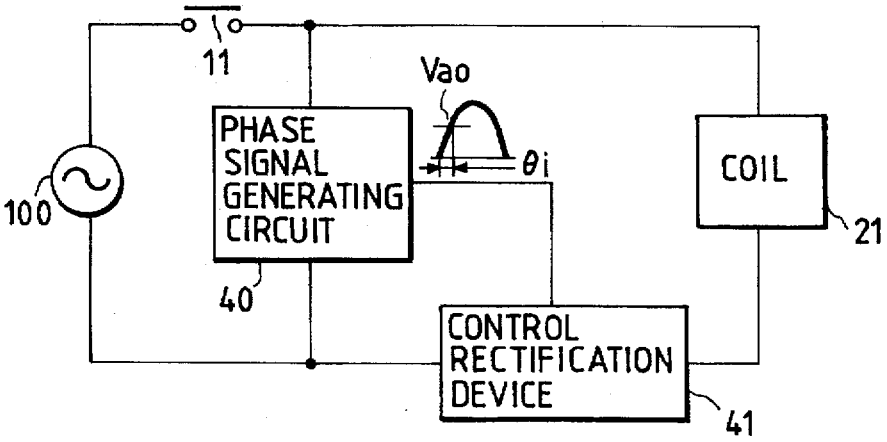
FIGS. 27(*a*)–27(*b*) respectively illustrate a circuit diagram and a graph of conventional art disclosed in Japanese Laid-Open Patent Publication No. SHO51-32297.
Figure 27B:
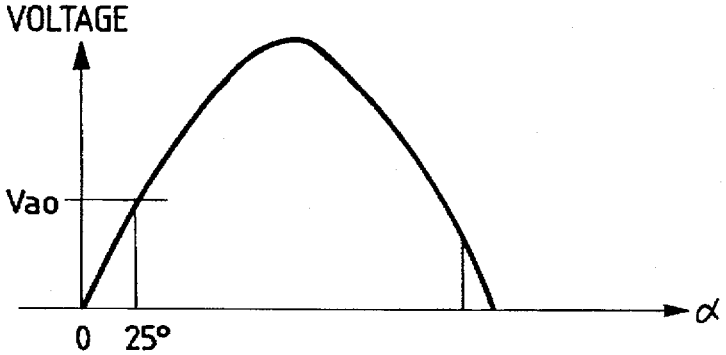
Figure 28:
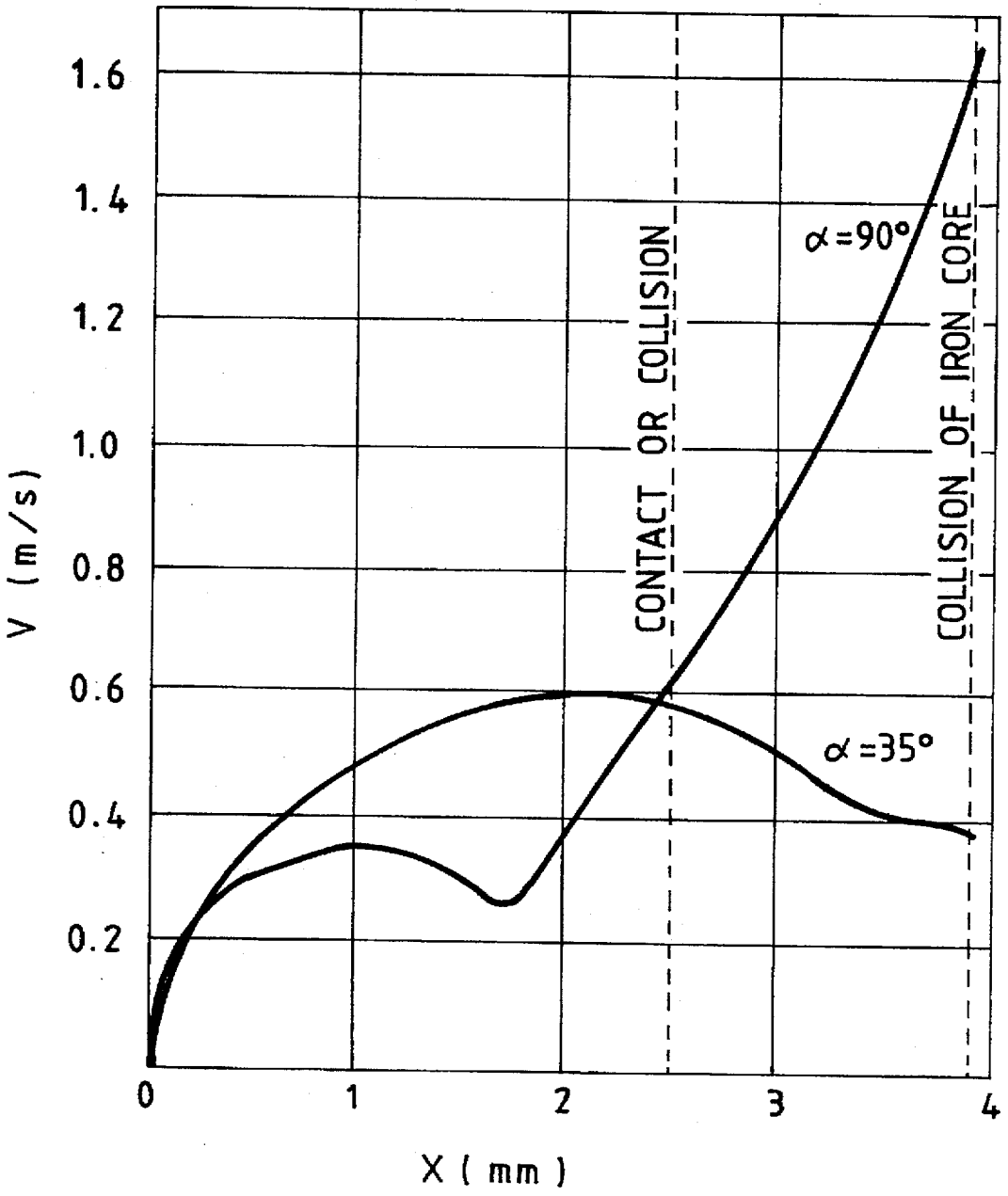
FIG. 28 is a characteristic curve of a conventional electromagnetic contactor.

Further, an embodiment wherein an arc prevention circuit is connected to a three-phase alternating-current power supply is shown in FIG. 25. In this embodiment, an inductance load, e.g., a motor 423, connected to a three-phase alternating-current power supply 425 is opened and closed by the contact 102. When the switch 160 is opened/closed, the electromagnet 101 is energized by the voltage of the alternating-current power supply 100 and the contact 102 can be opened/closed. By connecting an arc prevention circuit 440 across the contact 102, the present embodiment can also be applied to a three-phase alternating-current circuit. Because of the slow current changes in the load circuit connected to the contact 102, there is little electrical impact, e.g., high voltage and in-rush current, to the load circuit and the magnetic contactor for opening/closing a direct-current inductance load has a large effect. Also, since no high voltage takes place across the contact when it is opened/closed, the gap across the contact can be decreased and an arc barrier or the like for extinguishing arc discharges is not required, whereby the size and weight can be reduced, operation performed at high speed, life increased, and the price lowered. Further, the current in the load circuit connected to the contact changes slowly when the contact is opened/closed, and therefore, noises rarely occur.

It will be apparent that the first embodiment, as described above, achieves a magnetic contactor which energizes the coils at a phase angle at which the collision velocity of the movable iron core against the fixed iron core is lowered, whereby the impact of the movable iron core can be reduced and the life of the magnetic contactor increased.

It will be apparent that the second embodiment achieves a magnetic contactor which energizes the coils at a minimum phase angle at which the collision velocity of the movable iron core against the fixed iron core is lowered, whereby the operation time of the magnetic contactor can be decreased, the impact of the movable iron core reduced, and the life of the magnetic contactor increased.

It will be apparent that the third embodiment achieves a magnetic contactor whose actuation phase angle detector for giving a command to the switch comprises the first storage device of which reset is canceled by the operation signal and which is set by the output signal of the zero-cross detector, the comparator which compares the preset voltage and the alternating-current power supply voltage, and the second storage device of which reset is canceled by the operation signal and which is set by the output signals from the first storage device and the comparator, whereby the actuation phase angle of the magnetic contactor can be set accurately with ease.

It will be apparent that the fourth embodiment achieves a magnetic contactor which comprises a current detector for detecting the current of the series circuit where the magnetic contactor opening/closing switch, the electromagnet of the magnetic contactor and the phase angle controlling switch are connected in series with each other, and a voltage detector for detecting the voltage across the phase angle controlling switch, so that the actuation of the phase angle controlling switch is controlled according to the output of the voltage detector or that of the current detector, whereby the switch can be easily connected as a unit across the coils and the alternating-current power supply.

It will be apparent that the fifth embodiment achieves a magnetic contactor wherein the full-wave rectifying bridge is connected between the first switching device and the second switching device in the phase angle controlling switch and the resistor is connected to the output of the full-wave rectifying bridge in the current detector to detect a current flowing in the circuit according to the voltage of the resistor, whereby the ground potential of the current detector can be made common and an isolation amplifier is not required.

It will be apparent that the sixth embodiment achieves a magnetic contactor wherein the full-wave rectifying bridge connected in parallel with the contact of the magnetic contactor, the capacitor connected in series with the output of the full-wave rectifying bridge, and the circuit where the resistor and switching device are connected in series with the capacitor are connected and the voltage applied to the electromagnet of the magnetic contactor is detected to control the switching device on-off, whereby the impact of the movable iron core can be reduced, the life of the magnetic contactor increased, and further arc discharges generated across the contact minimized so that arc discharges at the time of chattering can be prevented and the life of the contact is dramatically increased.

What is claimed is:

1. A magnetic contactor device for controlling an electromagnet, having a movable iron core and a fixed iron core, based upon supply of voltage to said electromagnet from an alternating-current power supply to open and close a contact, said magnetic contactor device comprising:

a signal generator for generating a control signal;

switch means, responsive to said control signal, for controlling supply of said voltage from said alternating-current power supply to said electromagnet; and phase angle adjustment means for adjusting a phase angle, $\alpha$, at which said switch means switches on to supply said voltage to said electromagnet to energize said electromagnet;

said phase angle adjustment means being arranged to adjust said phase angle to a value at which a collision velocity of the movable iron core in said electromagnet against the fixed iron core is minimized, and where the differential value of said collision velocity of said movable iron core with respect to said phase angle is substantially zero.

2. The magnetic contactor device as defined in claim 1, wherein said switch means comprises a current switch connected in series with said electromagnet and said alternating-current power supply.

3. The magnetic contactor device as defined in claim 2, wherein said phase angle adjustment means comprises:

a storage device;

a zero cross detector which receives an output from said alternating-current power supply and which supplies an output signal to a set terminal of said storage device;

an inverter for inverting said control signal, and for supplying an inverted control signal to a reset terminal of said storage device; and a timer, connected to an output of said storage device, and having an output connected to an input of said current switch.

4. The magnetic contactor device as defined in claim 2, wherein said phase angle adjustment means comprises:

first storage means;

second storage means;

a comparator for comparing an output of said alternating-current power supply with a predetermined voltage;

a zero cross detector having an input connected to an output of said alternating-current power supply, and an output connected to a set terminal of said first storage means;

an AND circuit having inputs connected to respective outputs from said comparator and from said first storage means, an output of said AND circuit being supplied to a set terminal of said second storage means; and an inverter for inverting said control signal;

a reset terminal of both said first storage means and said second storage means being supplied with said inverted control signal.

5. The magnetic contactor device as defined in claim 1, further comprising:

a switch, wherein a series circuit, including said electromagnet and said switch means, is formed when said switch is closed;

a current detector for detecting the current in said series circuit; and a voltage detector for detecting a voltage across said switch means;

wherein actuation of said switch means is controlled in accordance with an output from one of said current detector and said voltage detector.

6. The magnetic contactor device as defined in claim 5, wherein said switch means comprises a phase angle controlling switch means having a first switch device and a second switch device, and wherein said current detector includes a full-wave rectifying bridge connected between said first switching device and said second switching device, and wherein a resistor is connected to an output of said full-wave rectifying bridge.

7. The magnetic contactor device as defined in claim 1, further comprising:

a full-wave rectifying bridge connected in parallel with a contact of a magnetic contactor;

a capacitor connected in series with an output of said full-wave rectifying bridge; and a resistor and a switching device being connected in series, said series connection of said resistor and said switching device being connected in parallel with said capacitor;

wherein said switching device is controlled by said voltage supplied to said electromagnet.

8. A magnetic contactor device for controlling an electromagnet, having a movable iron core and a fixed iron core, based upon supply of voltage to said electromagnet from an alternating-current power supply to open and close a contact, said magnetic contactor device comprising:

a signal generator for generating a control signal;

an OFF phase angle detector having input terminals respectively connected to an output of said alternating-current power supply and to an output of said signal generator;

actuation phase angle detecting and adjusting means, having input terminals respectively connected to said output of said alternating-current power supply and to an output of said OFF phase angle detector, for detecting and adjusting a phase angle at which said voltage is supplied to said electromagnet so that a collision velocity of the movable iron core in said electromagnet against the fixed core is minimized; and a current switch, having a terminal supplied with an output from said actuation phase angle detecting and adjusting means, said current switch being further connected in series with said electromagnet and said alternating-current power supply.

9. A magnetic contactor device for controlling an electromagnet, having a movable iron core and a fixed iron core, based upon supply of voltage to said electromagnet from an alternating-current power supply to open and close a contact, said magnetic contactor device comprising:

a signal generator for generating a control signal;

switch means, responsive to said control signal, for controlling supply of said voltage from said alternating-current power supply to said electromagnet; and phase angle adjustment means for adjusting a phase angle, $\alpha$, at which said switch means switches on to supply said voltage to said electromagnet to energize said electromagnet;

said phase angle adjustment means being arranged to adjust said electromagnet at a phase angle at which the collision velocity of the movable iron core in said electromagnet against the fixed iron core is minimized, wherein said phase angle is an earliest phase angle at which the differential value of the collision velocity v of the movable iron core with respect to said phase angle is substantially zero.

10. The magnetic contactor device as defined in claim 9, wherein said phase angle adjustment means comprises:

a storage device;

a zero cross detector which receives an output from said alternating-current power supply and which supplies an output signal to a set terminal of said storage device;

an inverter for inverting said control signal, and for supplying an inverted control signal to a reset terminal of said storage device; and a timer, connected to an output of said storage device, and having an output connected to an input of said current switch.

11. The magnetic contactor device as defined in claim 9, wherein said phase angle adjustment means comprises:

first storage means;

second storage means;

a comparator for comparing an output of said alternating-current power supply with a predetermined voltage;

a zero cross detector having an input connected to an output of said alternating-current power supply, and an output connected to a set terminal of said first storage means;

an AND circuit having inputs connected to respective outputs from said comparator and from said first storage means, an output of said AND circuit being supplied to a set terminal of said second storage means; and an inverter for inverting said control signal;

a reset terminal of both said first storage means and said second storage means being supplied with said inverted control signal.

12. The magnetic contactor device as defined in claim 9, further comprising:

a switch, wherein a series circuit, including said electromagnet and said switch means, is formed when said switch is closed;

a current detector for detecting the current in said series circuit; and a voltage detector for detecting a voltage across said switch means;

wherein actuation of said switch means is controlled in accordance with an output from one of said current detector and said voltage detector.

13. The magnetic contactor device as defined in claim 12, wherein said switch means comprises a phase angle controlling switch means having a first switch device and a second switch device, and wherein said current detector includes a full-wave rectifying bridge connected between said first switching device and said second switching device, and wherein a resistor is connected to an output of said full-wave rectifying bridge.

14. The magnetic contactor device as defined in claim 9, further comprising:

a full-wave rectifying bridge is connected in parallel with a contact of a magnetic contactor;

a capacitor connected in series with an output of said full-wave rectifying bridge; and a resistor and a switching device being connected in series, said series connection of said resistor and said switching device being connected in parallel with said capacitor;

wherein said switching device is controlled by said voltage supplied to said electromagnet.

* * * * *